US009439491B2

(12) United States Patent
Mazed

(10) Patent No.: US 9,439,491 B2
(45) Date of Patent: Sep. 13, 2016

(54) MULTIFUNCTIONAL HAIRBRUSH FOR DELIVERING A BIOACTIVE COMPOUND FOR GROWTH AND PROTECTION OF HAIR

(71) Applicant: Sayeeda Mazed, Yorba Linda, CA (US)

(72) Inventor: Sayeeda Mazed, Yorba Linda, CA (US)

( * ) Notice: Subject to any disclaimer, the term of this patent is extended or adjusted under 35 U.S.C. 154(b) by 0 days.

(21) Appl. No.: 14/121,398

(22) Filed: Aug. 29, 2014

(65) Prior Publication Data

US 2015/0059798 A1 Mar. 5, 2015

Related U.S. Application Data

(60) Provisional application No. 61/959,634, filed on Aug. 29, 2013.

(51) Int. Cl.

| | |
|---|---|
| ***A61Q 5/00*** | (2006.01) |
| ***A45D 19/16*** | (2006.01) |
| ***A45D 19/02*** | (2006.01) |
| ***A45D 20/50*** | (2006.01) |
| *A45D 19/00* | (2006.01) |

(52) U.S. Cl.

CPC ..... *A45D 19/16* (2013.01); *A45D 19/02* (2013.01); *A45D 20/50* (2013.01); *A45D 2019/0041* (2013.01)

(58) Field of Classification Search

None

See application file for complete search history.

(56) References Cited

U.S. PATENT DOCUMENTS

| | | | | |
|---|---|---|---|---|
| 8,221,746 | B2 * | 7/2012 | Isaacs | A61K 8/498 424/94.1 |
| 2009/0194125 | A1 * | 8/2009 | Anderson | A61K 8/19 132/207 |
| 2010/0106077 | A1 * | 4/2010 | Rabin | A61N 5/0616 604/20 |
| 2012/0004439 | A1 * | 1/2012 | Choi | A61K 8/553 558/169 |
| 2013/0017285 | A1 * | 1/2013 | Bhatia | A61K 8/44 424/769 |

* cited by examiner

*Primary Examiner* — H. Sarah Park

(57) ABSTRACT

Various embodiments of a multifunctional hairbrush are disclosed. The multifunctional hairbrush is configured to deliver a bioactive compound/biologically active molecule or a mixture of bioactive compounds/biologically active molecules for growth and protection of hair. Furthermore, the multifunctional hairbrush can be integrated with a low intensity light module to activate a bioactive compound/biologically active molecule or a mixture of bioactive compounds/biologically active molecules for growth and protection of hair.

20 Claims, 28 Drawing Sheets

MULTIFUNCTIONAL HAIRBRUSH FOR DELIVERING A BIOACTIVE COMPOUND FOR GROWTH AND PROTECTION OF HAIR

CROSS REFERENCE OF RELATED APPLICATION

The present application claims priority to: U.S. Provisional Patent Application No. 61/959,634 entitled "MULTIFUNCTIONAL HAIRBRUSH", filed on Aug. 29, 2013.

FIELD OF INVENTION

The present invention relates to a device generally comprising mechanical, electrical/electronic and optical components and/or subsystems: a multifunctional hairbrush. The multifunctional hairbrush is configured to deliver a bioactive compound/biologically active molecule (e.g., a regulatory protein/growth factor is a biologically active molecule) or a mixture of bioactive compounds/biologically active molecules for growth and protection of hair. The multifunctional hairbrush can be integrated with a detachable hair dryer.

BACKGROUND OF THE INVENTION

Hair is a biofilament of keratin protein. The hair care products are indispensable in everyone's daily life. Taking care of hair is not only the requirement for hygiene, but also it symbolizes fashion and lifestyle. The present invention describes a multifunctional hairbrush, which is configured to deliver a bioactive compound/biologically active molecule or a mixture of bioactive compounds/biologically active molecules for growth and protection of hair. The multifunctional hairbrush can be integrated with a detachable hair dryer.

SUMMARY OF THE INVENTION

First embodiment of the present invention is a hairbrush with a detachable/stretchable mesh structured net, which is configured to fit on any standard hairbrush. The detachable/stretchable mesh structured net can be utilized to remove loose hair.

Second embodiment of the present invention is a hairbrush with a detachable/stretchable mesh structured net, which is embedded with a bioactive compound/biologically active molecule or a mixture of bioactive compounds/biologically active molecules for growth and protection of hair.

Furthermore, it should be noted that a hairbrush can be substituted by a comb in the first and second embodiment of the present invention.

Third embodiment of the present invention is a hairbrush with a detachable hair/scalp massager.

Fourth embodiment of the present invention is a hairbrush with (a) a detachable hair/scalp massager and (b) a detachable/stretchable mesh structured net.

Fifth embodiment of the present invention is a hairbrush with (a) a detachable hair/scalp massager and (b) a detachable/stretchable mesh structured net, which is embedded with a bioactive compound/biologically active molecule or a mixture of bioactive compounds/biologically active molecules for growth and protection of hair.

Sixth embodiment of the present invention is a hairbrush with (a) a detachable hair/scalp massager and (b) a detachable spray applicator of a bioactive compound/biologically active molecule or a mixture of bioactive compounds/biologically active molecules (in a liquid form) for growth and protection of hair.

Seventh embodiment of the present invention is a detachable hair dryer.

Eighth embodiment of the present invention is (a) a hairbrush, (b) a detachable/stretchable mesh structured net and (c) a detachable hair dryer.

Ninth embodiment of the present invention is (a) a hairbrush, (b) a detachable/stretchable mesh structured net, which is embedded with a bioactive compound/biologically active molecule or a mixture of bioactive compounds/biologically active molecules for growth and protection of hair and (c) a detachable hair dryer.

Tenth embodiment of the present invention is (a) a hairbrush, (b) a detachable/stretchable mesh structured net, (c) a detachable hair/scalp massager and (d) a detachable hair dryer.

Eleventh embodiment of the present invention is (a) a hairbrush, (b) a detachable/stretchable mesh structured net, which is embedded with a bioactive compound/biologically active molecule or a mixture of bioactive compounds/biologically active molecules for growth and protection of hair, (c) a detachable hair/scalp massager and (d) a detachable hair dryer.

Twelfth embodiment of the present invention is (a) a hairbrush, (b) a detachable spray applicator of a bioactive compound/biologically active molecule or a mixture of bioactive compounds/biologically active molecules (in a liquid form) for growth and protection of hair, (c) a detachable hair/scalp massager and (d) a detachable hair dryer.

Thirteenth embodiment of the present invention is (a) a hairbrush, (b) a detachable spray applicator of a bioactive compound/biologically active molecule or a mixture of bioactive compounds/biologically active molecules (in a liquid form) for growth and protection of hair, (c) a detachable hair/scalp massager and (d) a low intensity light module for growth and protection of hair.

Present invention also describes printing of a hairbrush with or without a hair dryer by a fast three-dimensional (3-D) printer enabled by (a) a larger diameter nozzle for material input and (b) an ultrahigh power pulsed fiber laser.

Present invention also describes a scaffold printed by a three-dimensional (3-D) printer in a photosensitive (biocompatible) material for containing a bioactive compound/biologically active molecule or a mixture of bioactive compounds/biologically active molecules for growth and protection of hair.

BRIEF DESCRIPTION OF THE TABLES

Table 1 describes various compositions of a detachable/stretchable mesh structured net.

Table 2 describes various compositions of a detachable/stretchable mesh structured net.

Table 3 describes various compositions of a detachable/stretchable mesh structured net.

Table 4 describes various compositions of a detachable/stretchable mesh structured net.

DETAIL DESCRIPTION OF THE INVENTION

Figure 1A:
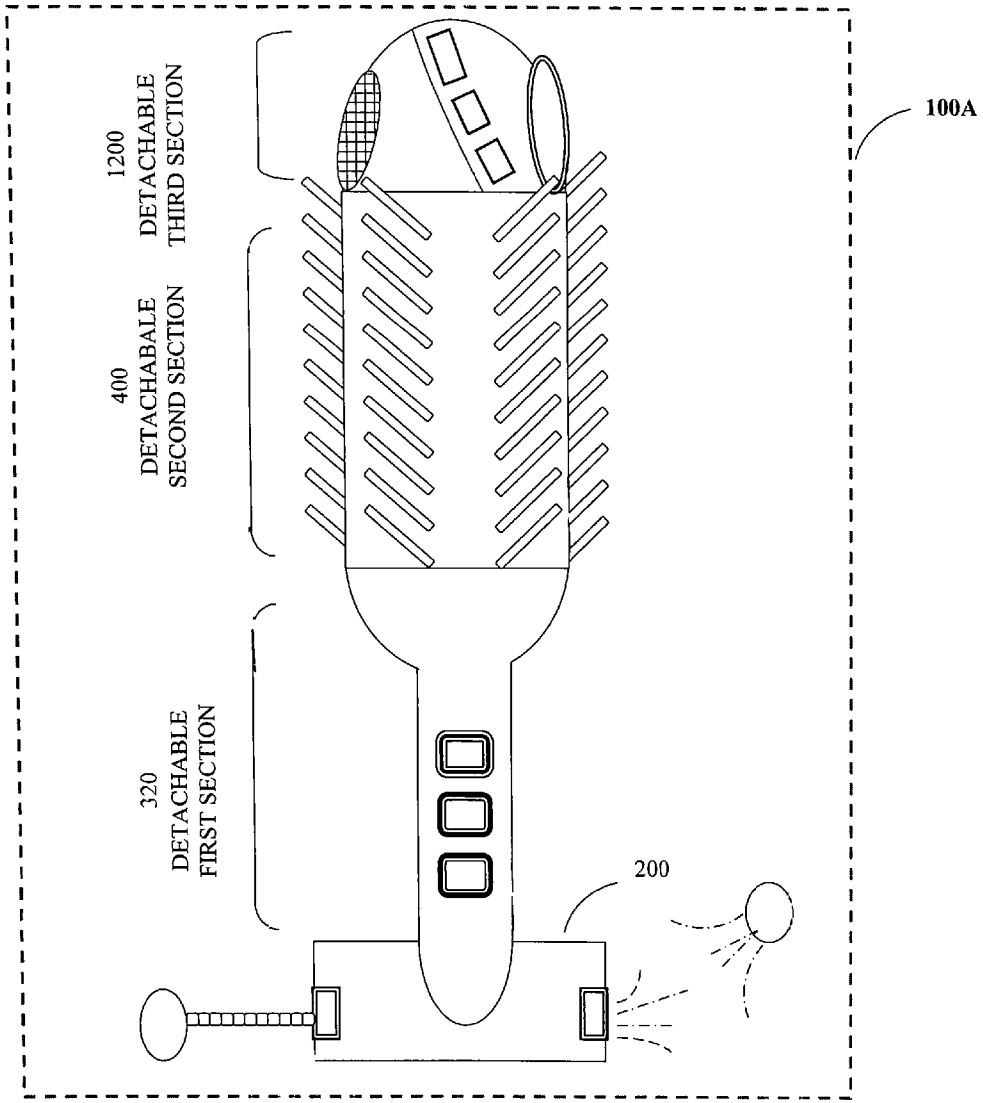
FIG. 1A illustrates one embodiment of a hairbrush.

FIG. 1A illustrates one embodiment of a hairbrush indicated by 100A and an electrical/wireless charging unit 200. 100A includes (a) a detachable first section 320, (b) a detachable bristles' section 400 and (c) a detachable third section (hair dryer) 1200.

Figure 1B:
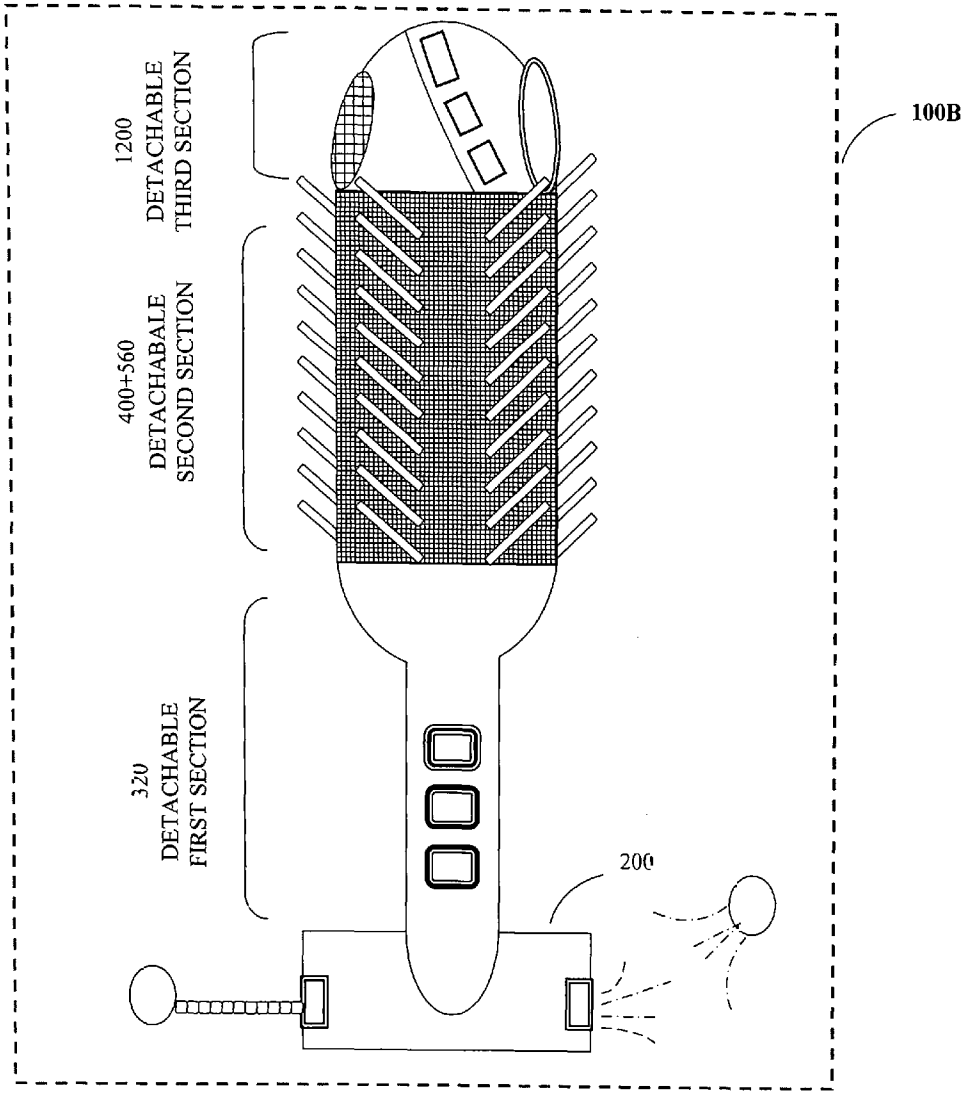
FIG. 1B illustrates another embodiment of the hairbrush.

FIG. 1B illustrates another embodiment of a hairbrush indicated by 100B and an electrical/wireless charging unit 200. 100B includes (a) the detachable first section 320, (b) a detachable second section (which includes the detachable bristles' section 400 and a detachable/stretchable mesh structured net 560) and (c) the detachable third section (hair dryer) 1200.

Figure 1C:
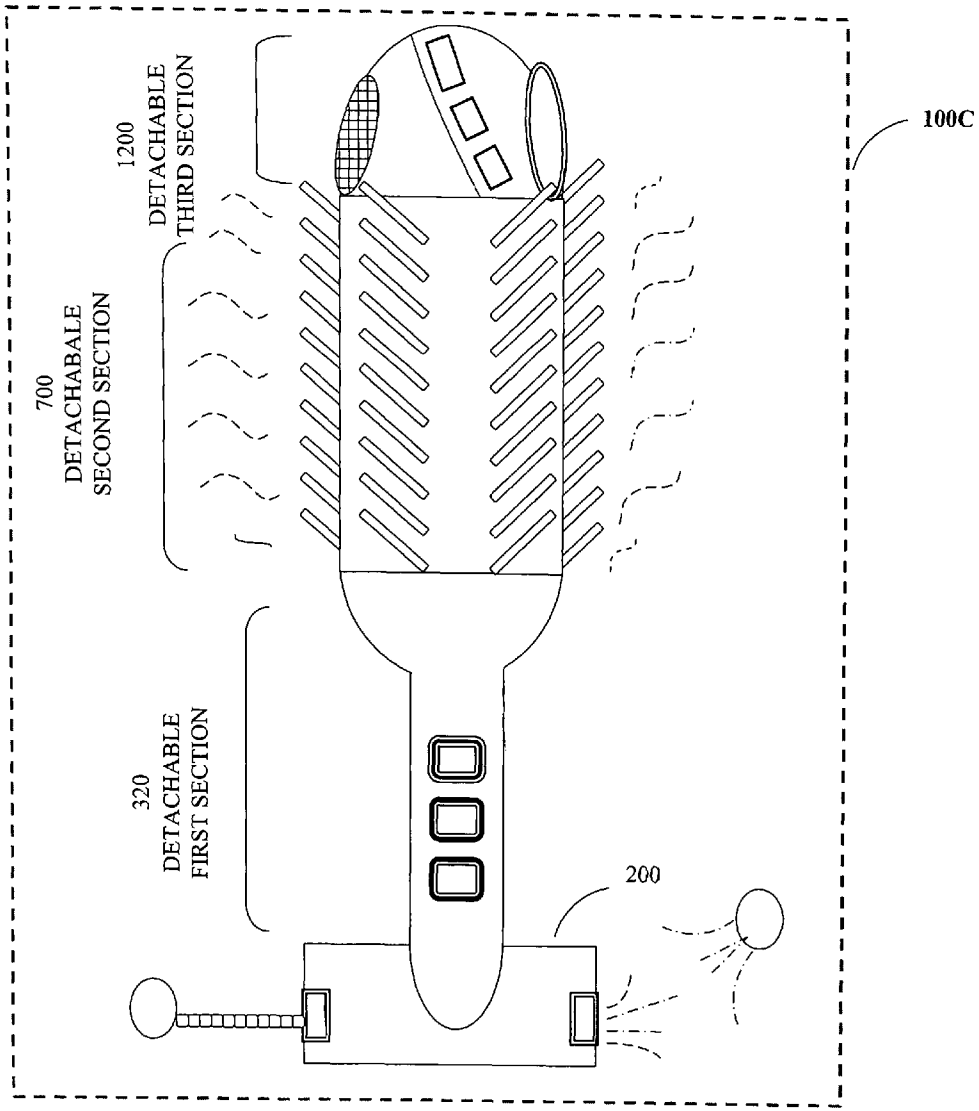
FIG. 1C illustrates another embodiment of the hairbrush.

FIG. 1C illustrates another embodiment of a hairbrush indicated by 100C and an electrical/wireless charging unit 200. 100C includes (a) the detachable first section 320, (b) a detachable second section 700 (which includes a detachable hair/scalp massager integrated with bristles) and (c) the detachable third section (hair dryer) 1200.

Figure 1D:
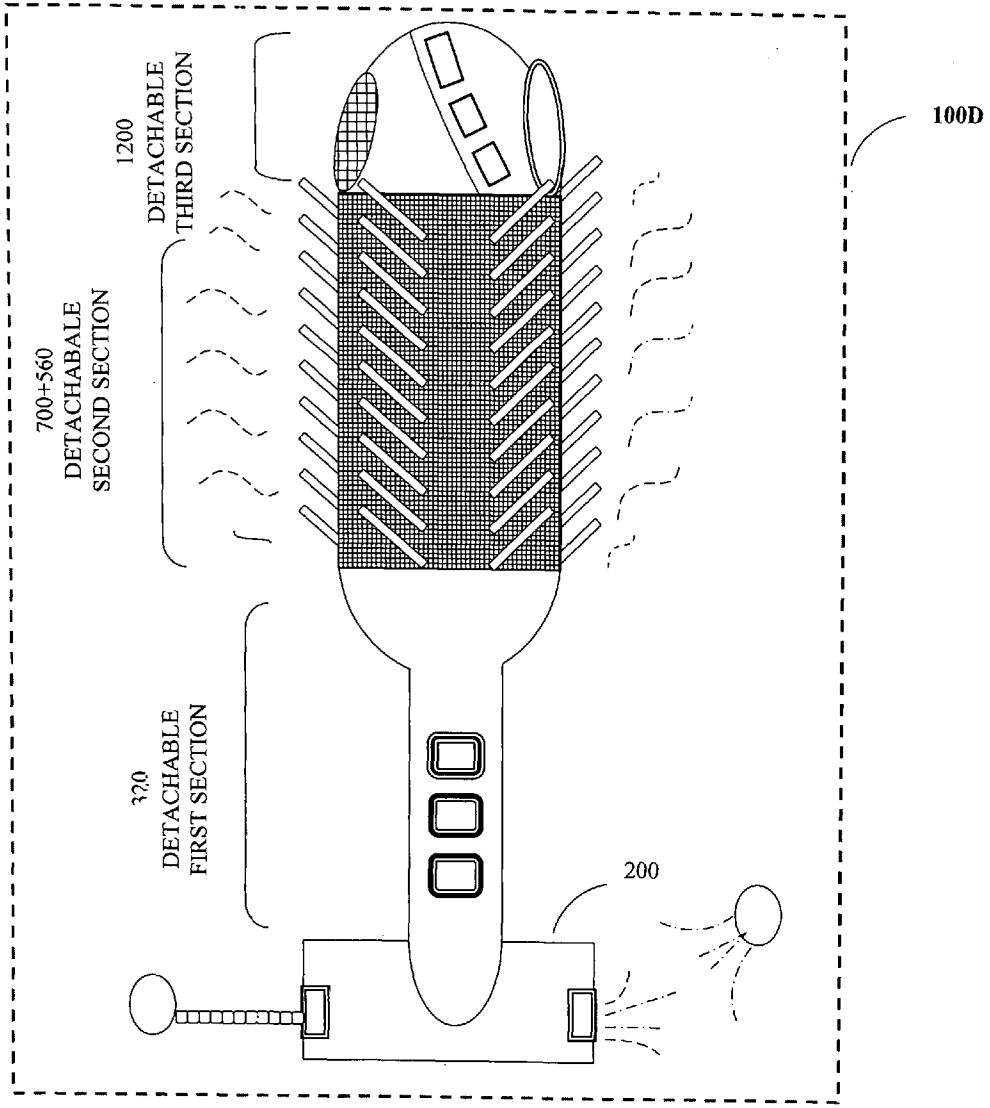
FIG. 1D illustrates another embodiment of the hairbrush.

FIG. 1D illustrates another embodiment of a hairbrush indicated by 100D and an electrical/wireless charging unit 200. 100D includes (a) the detachable first section 320, (b) the detachable second section (which includes a detachable hair/scalp massager (integrated with detachable bristles) 700 and a detachable/stretchable mesh structured net (embedded with a bioactive compound/biologically active molecule or a mixture of bioactive compounds/biologically active molecules for growth and protection of hair) 560 and (c) the detachable third section (hair dryer) 1200.

Figure 1E:
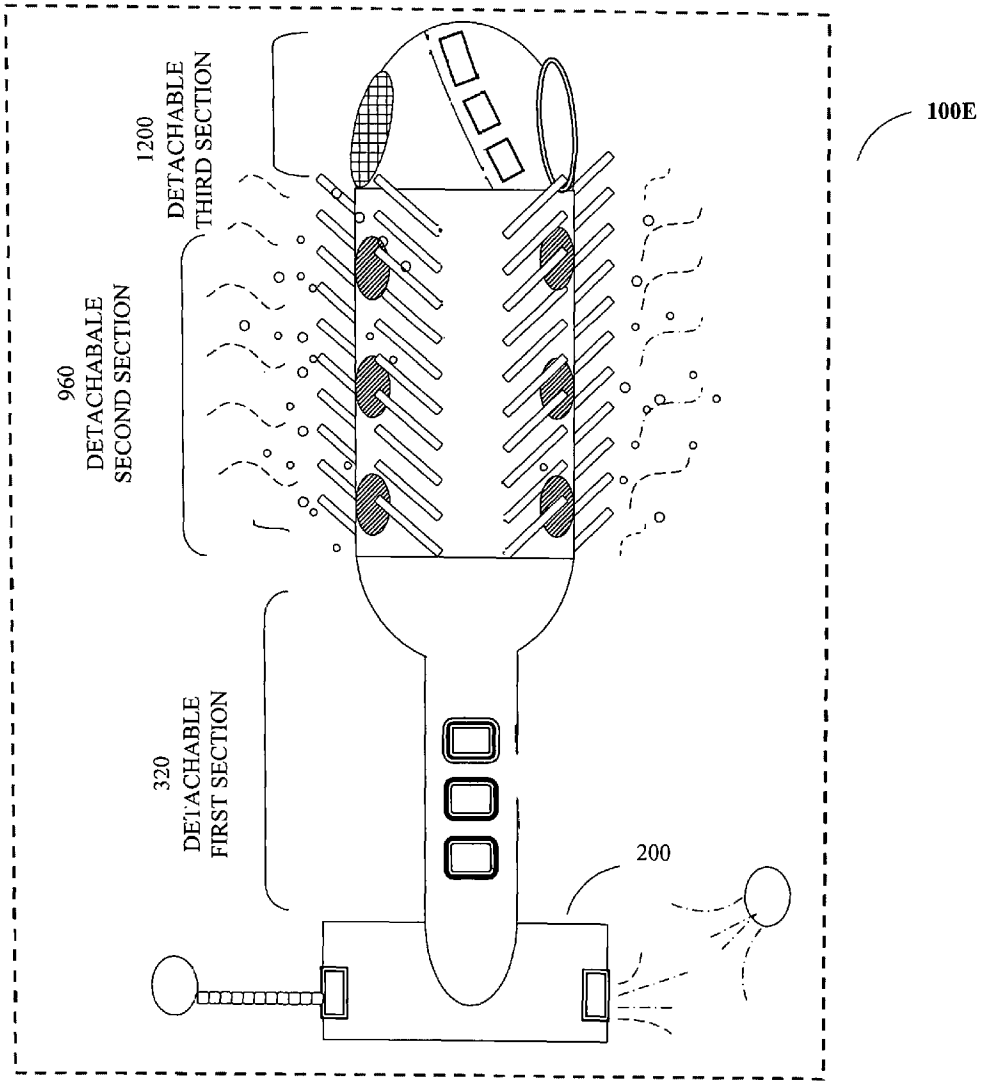
FIG. 1E illustrates another embodiment of the hairbrush.

FIG. 1E illustrates another embodiment of a hairbrush indicated by 100E and an electrical/wireless charging unit 200. 100E includes (a) the detachable first section 320, (b) a detachable second section 960 (which includes a detachable vibrator with spray applicator (of a bioactive compound/biologically active molecule or a mixture of bioactive compounds/biologically active molecules (in liquid form) for growth and protection of hair) integrated with bristles and (c) the detachable third section (hair dryer) 1200.

Figure 2A:
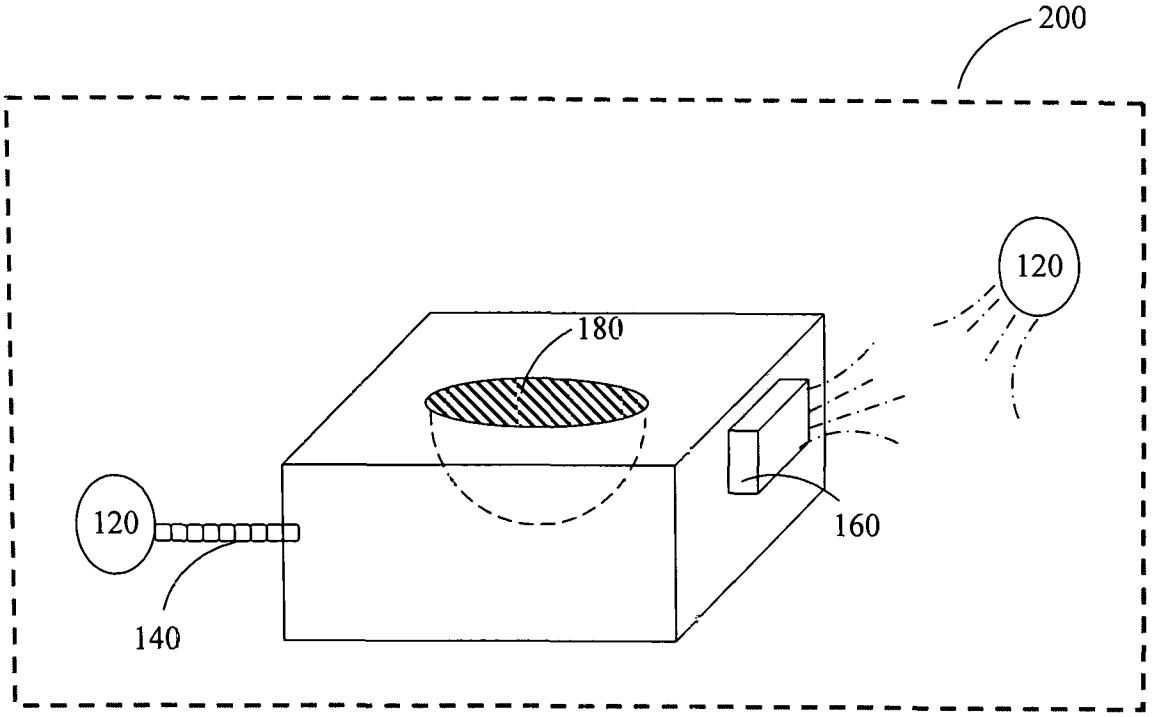
FIG. 2A illustrates an electrical/wireless charging unit.

FIG. 2A illustrates a wired/wireless charging subsystem 200, wherein an electrical plug/socket is indicated by 120, an electrical cable/retractable electrical cable is indicated by 140, a wireless charger is indicated by 160 and a charging socket is indicated by 180 to orient the hairbrush indicated by 100A or 100B or 100C or 100D or 100E in an upright position.

Figure 2B:
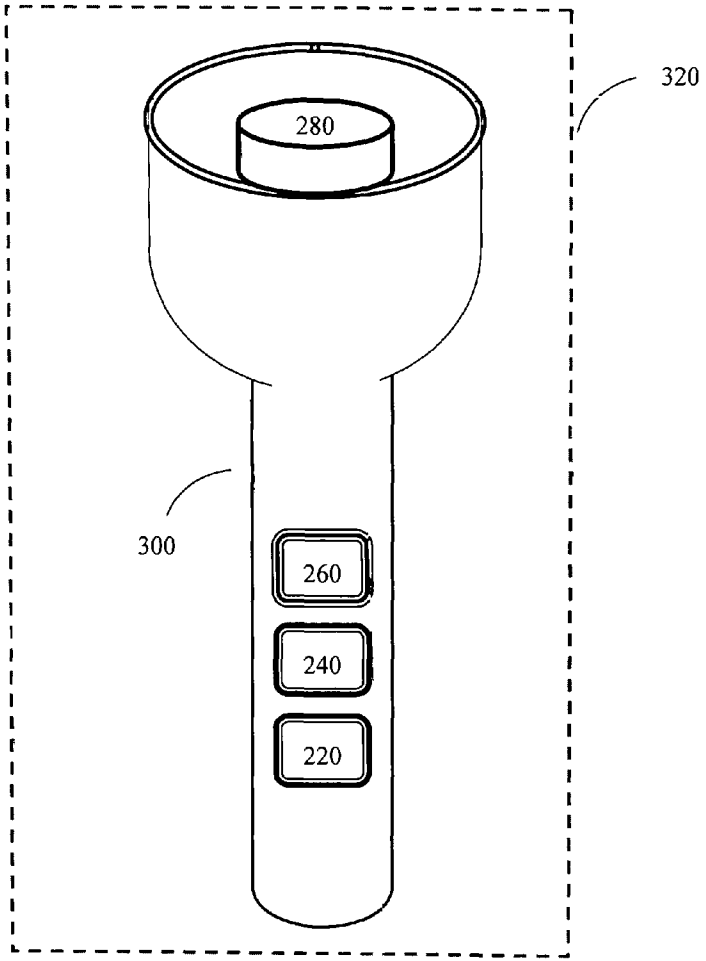
FIG. 2B illustrates a detachable first section.

FIG. 2B illustrates the detachable first section 320, wherein a power indicator is indicated by 220, a vibration indicator is indicated by 240, a spray indicator is indicated by 260, an electrical contact area is indicated by 280 and an upright stand is indicated by 300.

Figure 2C:
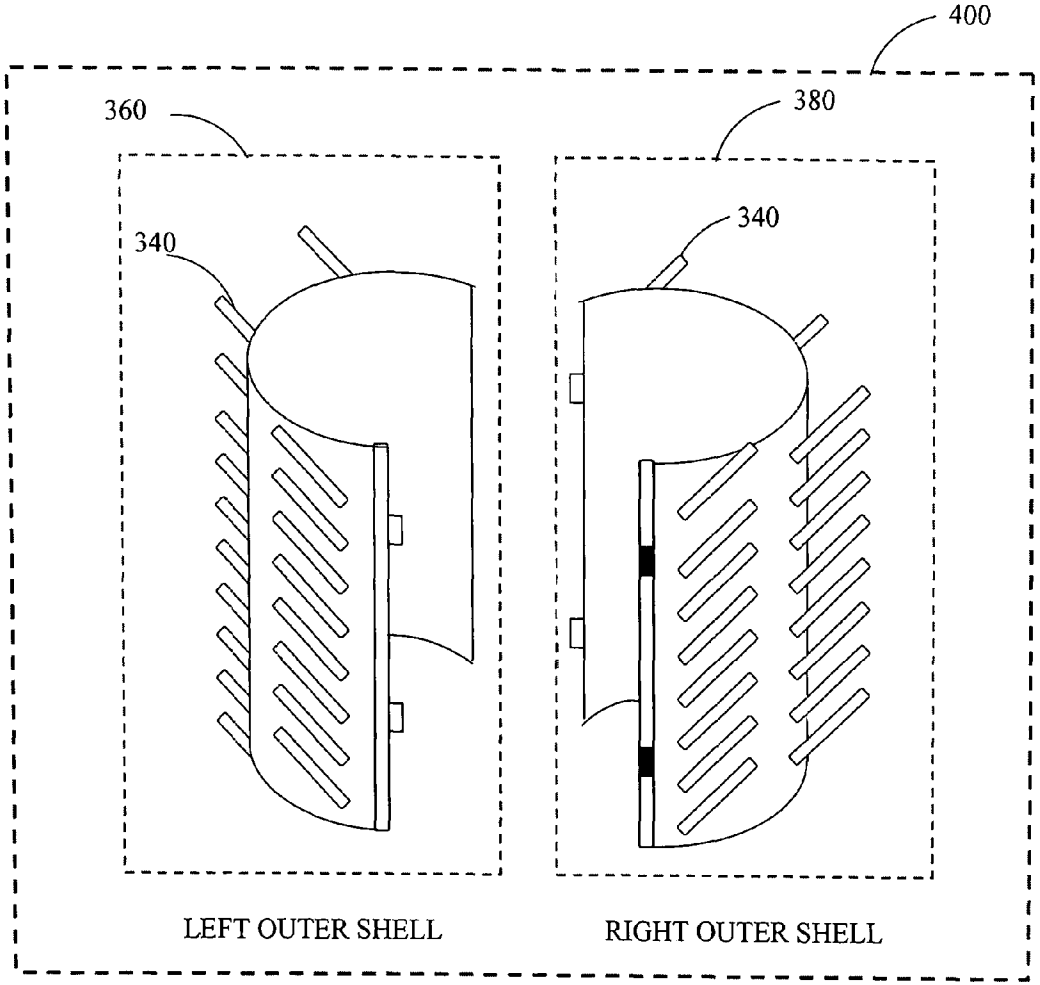
FIG. 2C illustrates a two-part detachable bristles' structure.

FIG. 2C illustrates a two-part detachable bristles' structure 400, wherein the left outer shell is indicated by 360 and right outer shell is indicated by 380. Both left outer shell 360 and right outer shell 380 have an array of bristle, wherein the bristle is indicated by 340.

In ultrasound, a wave generator can be connected to the left outer shell 360 or the right outer shell 380, causing the liquid molecules to vibrate at a specific amplitude and frequency and also generating microscopic bubbles. These microscopic bubbles can act like nanosized gentle scrubbers for effective cleaning.

Figure 2D:
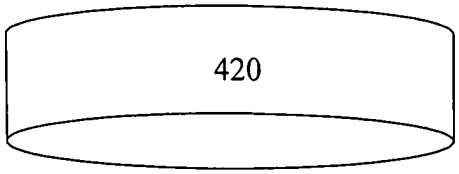
FIG. 2D illustrates a detachable end cap.

FIG. 2D illustrates the detachable end cap 420.

Figure 2E:
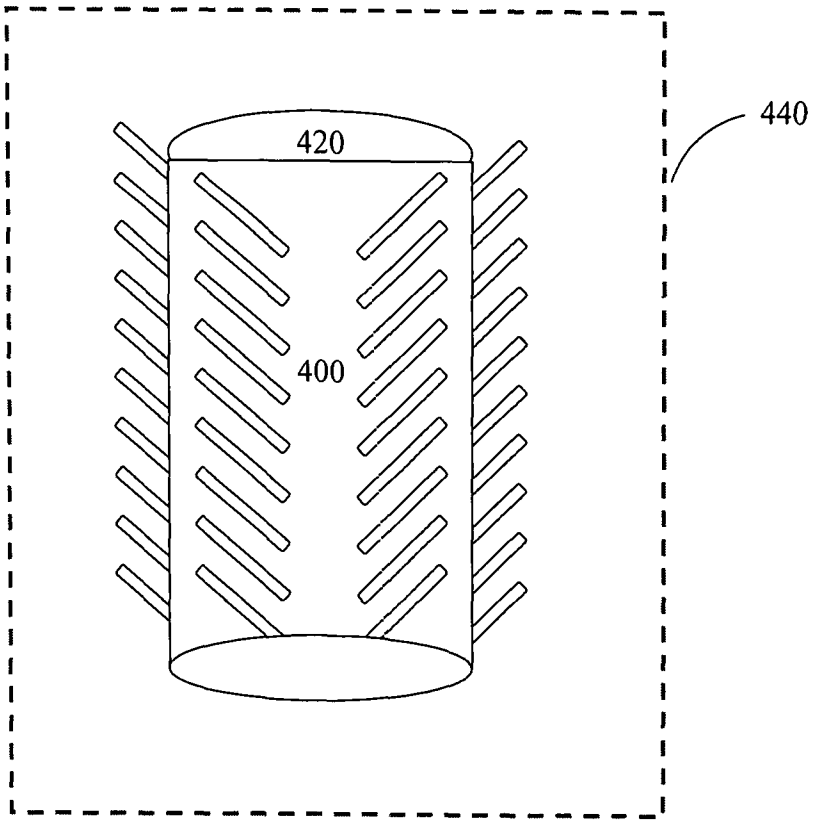
FIG. 2E illustrates a detachable second section, which includes (a) a detachable bristles' structure and (b) an end cap.

FIG. 2E illustrates an (integrated) second section 440, which includes (a) the detachable bristles' structure 400 and (b) the detachable end cap 420.

Figure 2F:
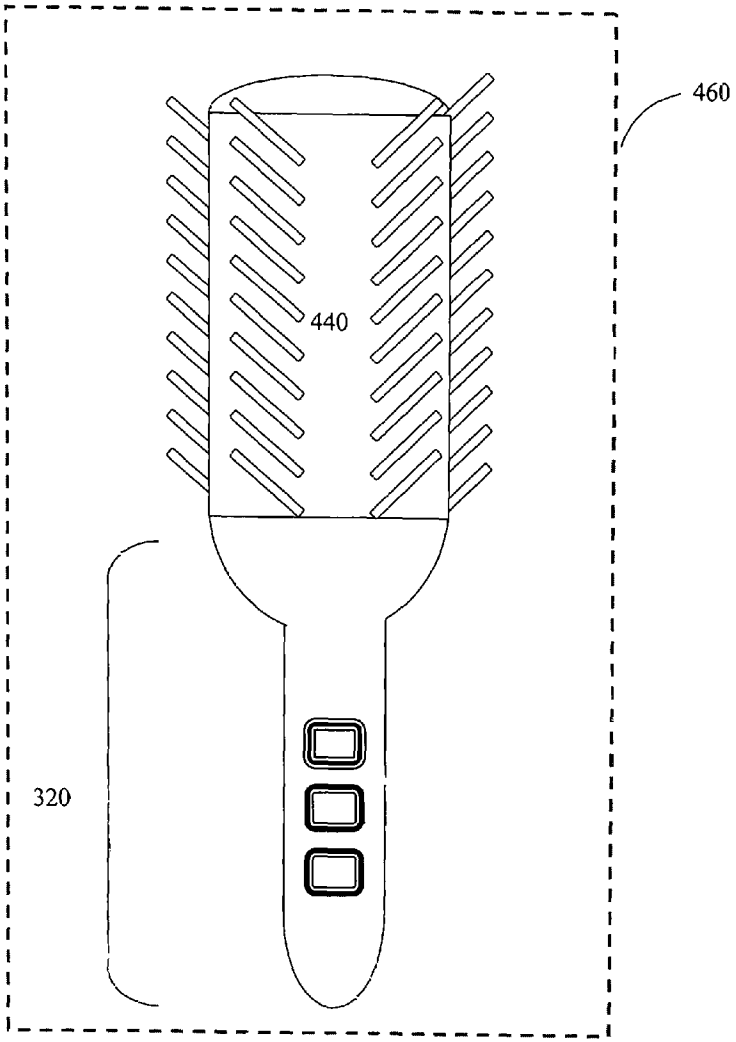
FIG. 2F illustrates a hairbrush, which includes (a) a detachable first section and (b) a detachable second section.

FIG. 2F illustrates a hairbrush 460, which includes (a) the detachable first section 320 and (b) the detachable (integrated) second section 440.

The care of hair and scalp may appear separate. But they are actually intertwined, as hair grows from beneath the scalp. Cleaning of hairbrush has various problems, as its bristles get clogged with loose hair, dandruff, harmful bacteria and microbes/insects (e.g., lice). Cleaning of hairbrush is important to inhibit dandruff, harmful bacteria and microbes/insects.

Figure 3A:
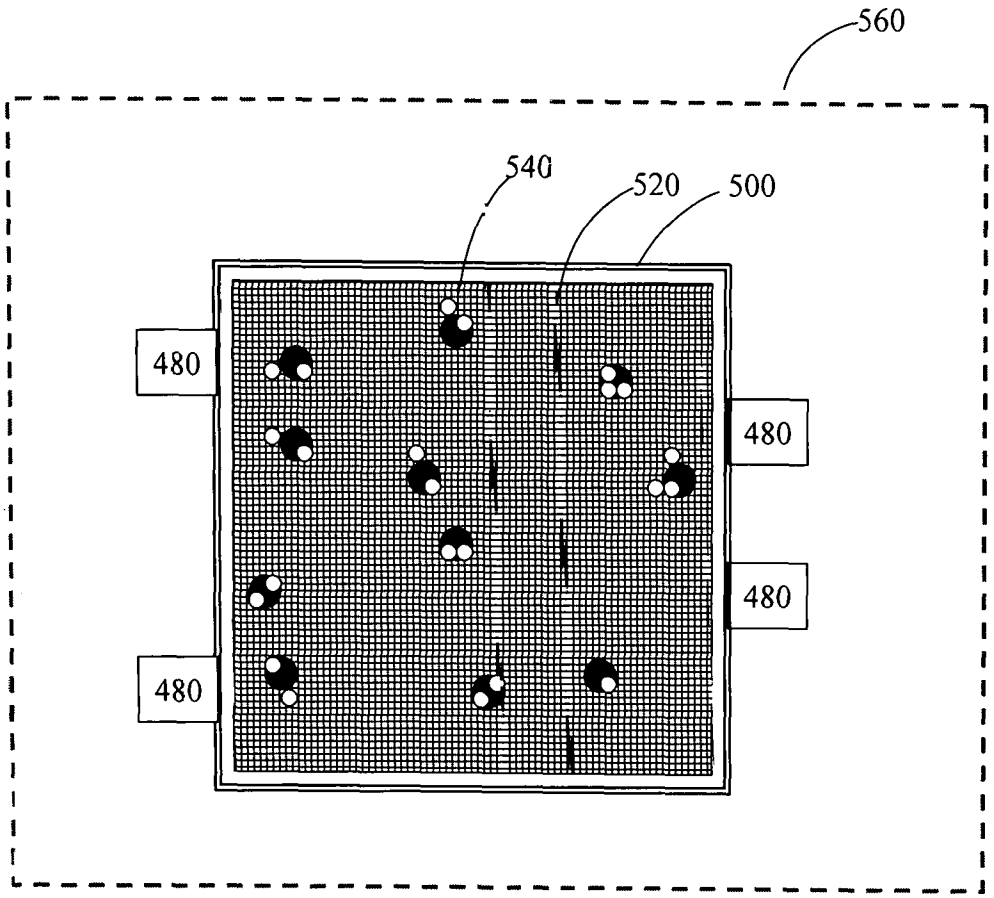
FIG. 3A illustrates a detachable/stretchable mesh structured net (which is embedded with a bioactive compound/biologically active molecule or a mixture of bioactive compounds/biologically active molecules for growth and protection of hair).

FIG. 3A illustrates an integrated detachable/stretchable mesh structured net 560, which includes a sticker 480, an elastic frame 500 (configured to fit the contour of a hairbrush or a comb), a mesh structured net (of a suitable material) 520 and a bioactive compound/biologically active molecule for growth and protection of hair 540.

By way of an example and not by way of any limitation, the material for detachable/stretchable mesh structured net 520 can be hydrogel, plastic or silk.

By way of an example and not by way of any limitation, the material for detachable/stretchable mesh structured net 520 is described in Table 1, Table 2, Table 3 and Table 4.

TABLE 1

| Composition | Wt % Material A | Wt % Material B |
|---|---|---|
| 1 | 80% Hydrogel | 20% Chitosan |
| 2 | 80% Hydrogel | 20% Chitin |
| 3 | 80% Hydrogel | 20% Fibroin |

TABLE 2

| Composition | Wt % Material A | Wt % Material B | Wt % Material C |
|---|---|---|---|
| 1 | 80% Hydrogel | 10% Chitosan | 10% Chitin |
| 2 | 80% Hydrogel | 10% Chitosan | 10% Fibroin |
| 3 | 80% Hydrogel | 10% Chitin | 10% Fibroin |

TABLE 3

| Composition | Wt % Material A | Wt % Material B | Wt % Material C |
|---|---|---|---|
| 1 | 70% Hydrogel | 15% Chitosan | 15% Chitin |
| 2 | 70% Hydrogel | 15% Chitosan | 15% Fibroin |
| 3 | 70% Hydrogel | 15% Chitin | 15% Fibroin |

TABLE 4

| Composition | Wt % Material A | Wt % Material B | Wt % Material C |
|---|---|---|---|
| 1 | 60% Hydrogel | 20% Chitosan | 20% Chitin |
| 2 | 60% Hydrogel | 20% Chitosan | 20% Fibroin |
| 3 | 60% Hydrogel | 20% Chitin | 20% Fibroin |

Furthermore, the detachable/stretchable mesh structured net 520 can include a scaffold, wherein the scaffold can be printed by three-dimensional (3-D) printing in a photosensitive (biocompatible) material, wherein photosensitive molecules harden only when they absorb two photons from a laser beam.

The scaffolds can suitably contain a bioactive compound/biologically active molecule or a mixture of bioactive compounds/biologically active molecules for growth and protection of hair.

Furthermore, the bioactive compound/molecule or the mixture of bioactive compounds/molecules can be encapsulated or caged within a nanoshell, wherein the nanoshell is described in paragraph 101.

It should be noted that the scaffold 1540 (fabricated in a photosensitive biocompatible material) can be attached to biological cells, printed biological cells (e.g., blood vessels formed by printing artificial biological molecules with a three-dimensional (3-D) inkjet bioprinter and then shaped by a laser beam) or live biological cells, wherein the scaffold suitably contains a bioactive compound/biologically active molecule or a mixture of bioactive compounds/biologically active molecules for growth and protection of hair.

The above bioactive compound/biologically active molecule or the mixture of bioactive compounds/biologically active molecules for growth and protection of hair within a scaffold can be activated by low intensity light (e.g., utilizing an array of vertical cavity surface emitting continuous wave (CW)/pulsed lasers or an array of light emitting diodes of a suitable wavelength range).

The low intensity light can induce a minute quantity of chemically reactive oxygen molecules such that in a minute quantity these chemically reactive oxygen molecules can beneficially stimulate certain cellular functions.

Figure 3B:
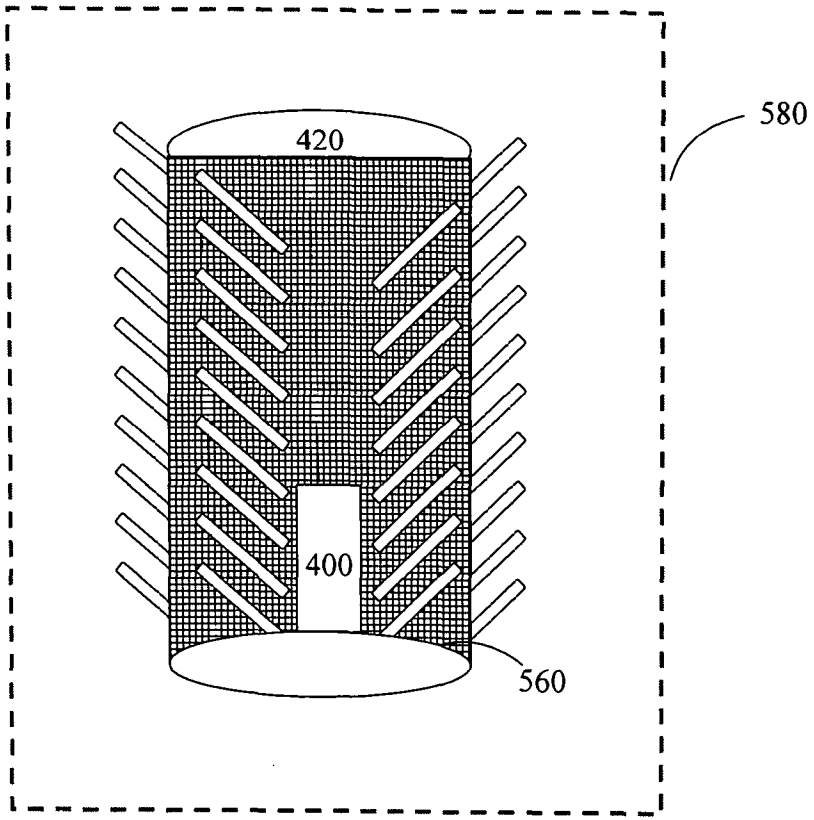
FIG. 3B illustrates a detachable second section, which includes (a) a detachable bristles, (b) a detachable/stretchable mesh structured net (which is embedded with a bioactive compound/biologically active molecule or a mixture of bioactive compounds/biologically active molecules for growth and protection of hair) and (c) a detachable end cap.

FIG. 3B illustrates a detachable (integrated) second section 580, which includes (a) the detachable bristles 400, (b) the integrated detachable/stretchable mesh structured net 560 and (c) the detachable end cap 420.

Figure 3C:
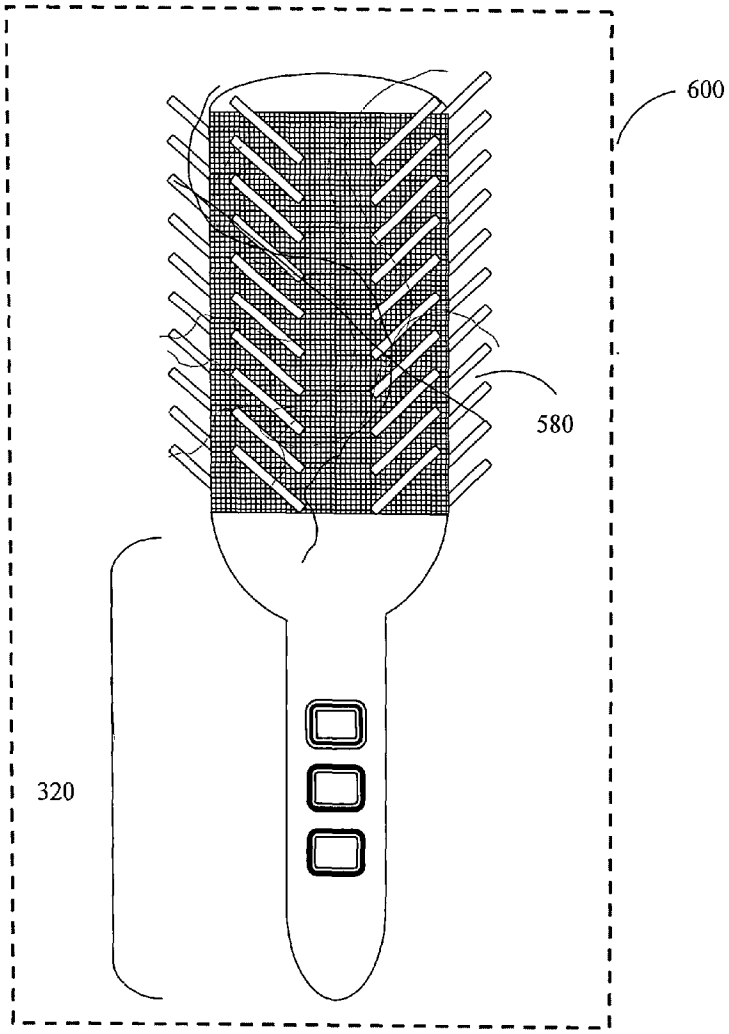
FIG. 3C illustrates a hairbrush, which includes (a) a detachable first section and a detachable second section.

FIG. 3C illustrates a hairbrush 600, which includes (a) the detachable first section 320 and a detachable (integrated) second section 580. FIG. 3C also illustrates the loose hair trapped in the detachable (integrated) second section 580.

Figure 4A:
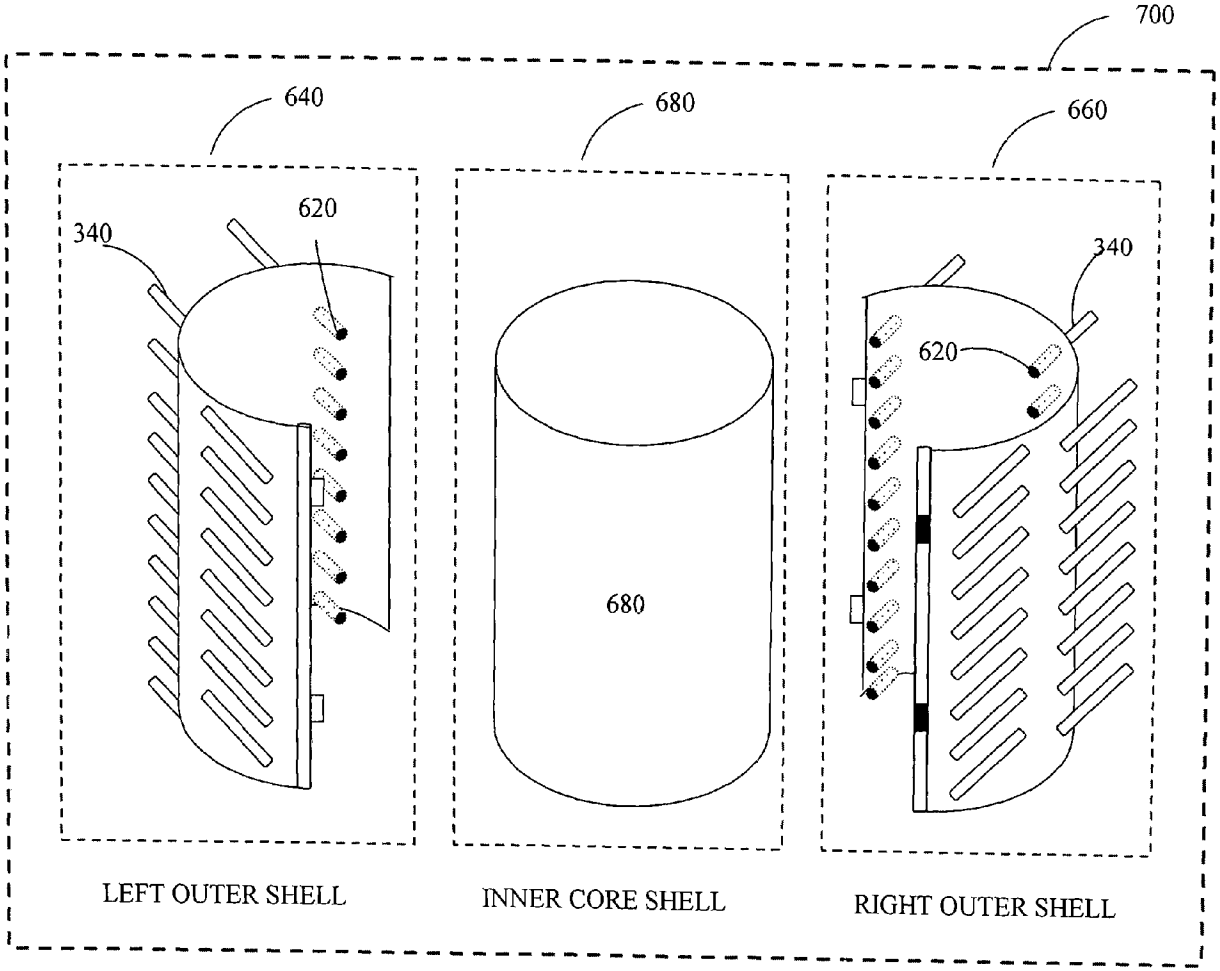
FIG. 4A illustrates a detachable vibrator structure (along with a detachable bristles' structure) to enable gentle mechanical vibration.

FIG. 4A illustrates a detachable vibrator structure (along with a detachable bristles' structure) 700 to enable gentle mechanical and/or ultrasound vibration, which includes (a) a left outer shell 640, (b) a right outer shell 660 and (c) an inner core shell 680. Both the left outer shell 640 and right outer shell 660 has an array of bristles indicted by 340.

Furthermore, end of each bristle has a miniature magnet 620 for intimate attachment to the inner core shell 680.

Figure 4B:
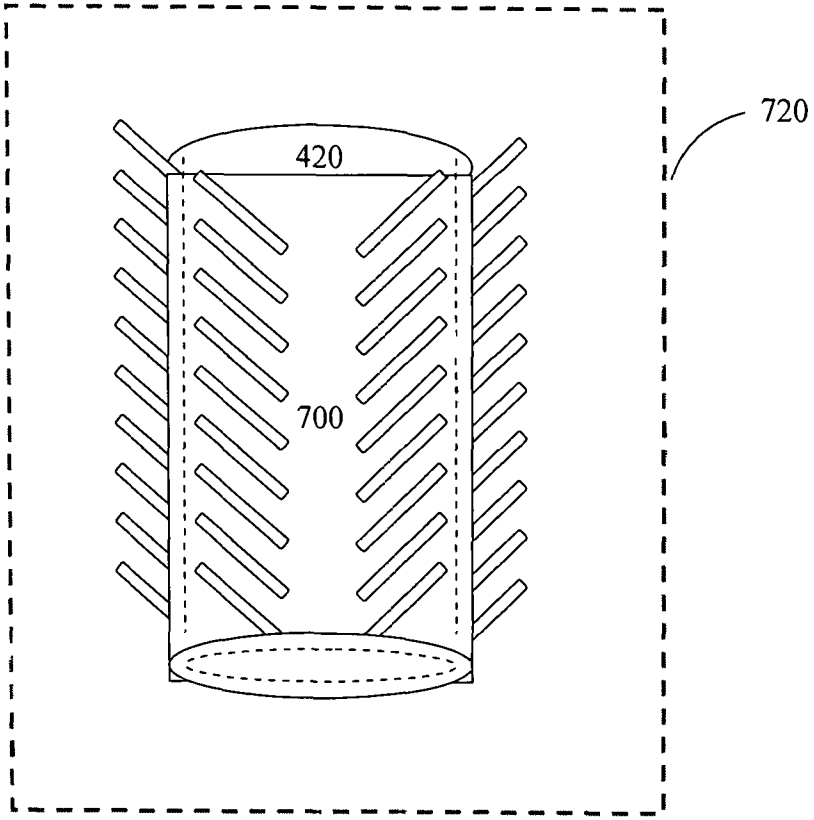
FIG. 4B illustrates a detachable second section, which includes (a) a detachable vibrator structure (along with a detachable bristles' structure) and (b) a detachable end cap.

FIG. 4B illustrates a detachable (integrated) second section 720, which includes (a) the detachable vibrator structure (along with the detachable bristles' structure) 700 and (b) the detachable end cap 420.

Figure 4C:
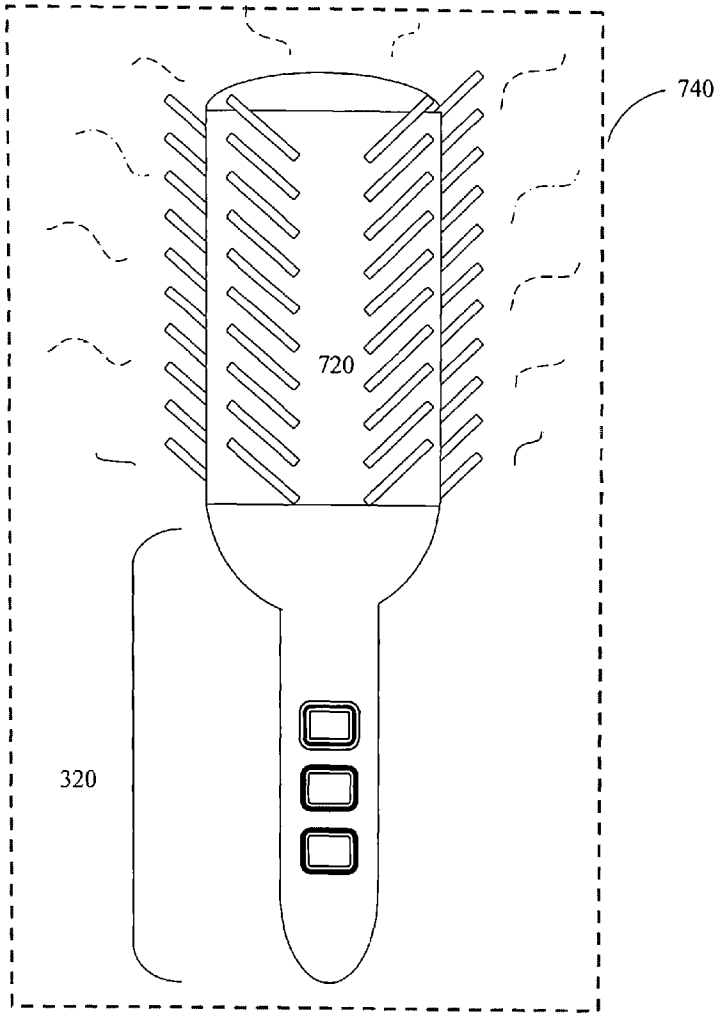
FIG. 4C illustrates a hairbrush, which includes (a) a detachable first section and a detachable second section.

FIG. 4C illustrates a hairbrush 740, which includes (a) the detachable first section 320 and the detachable (integrated) second section 720.

Figure 5A:
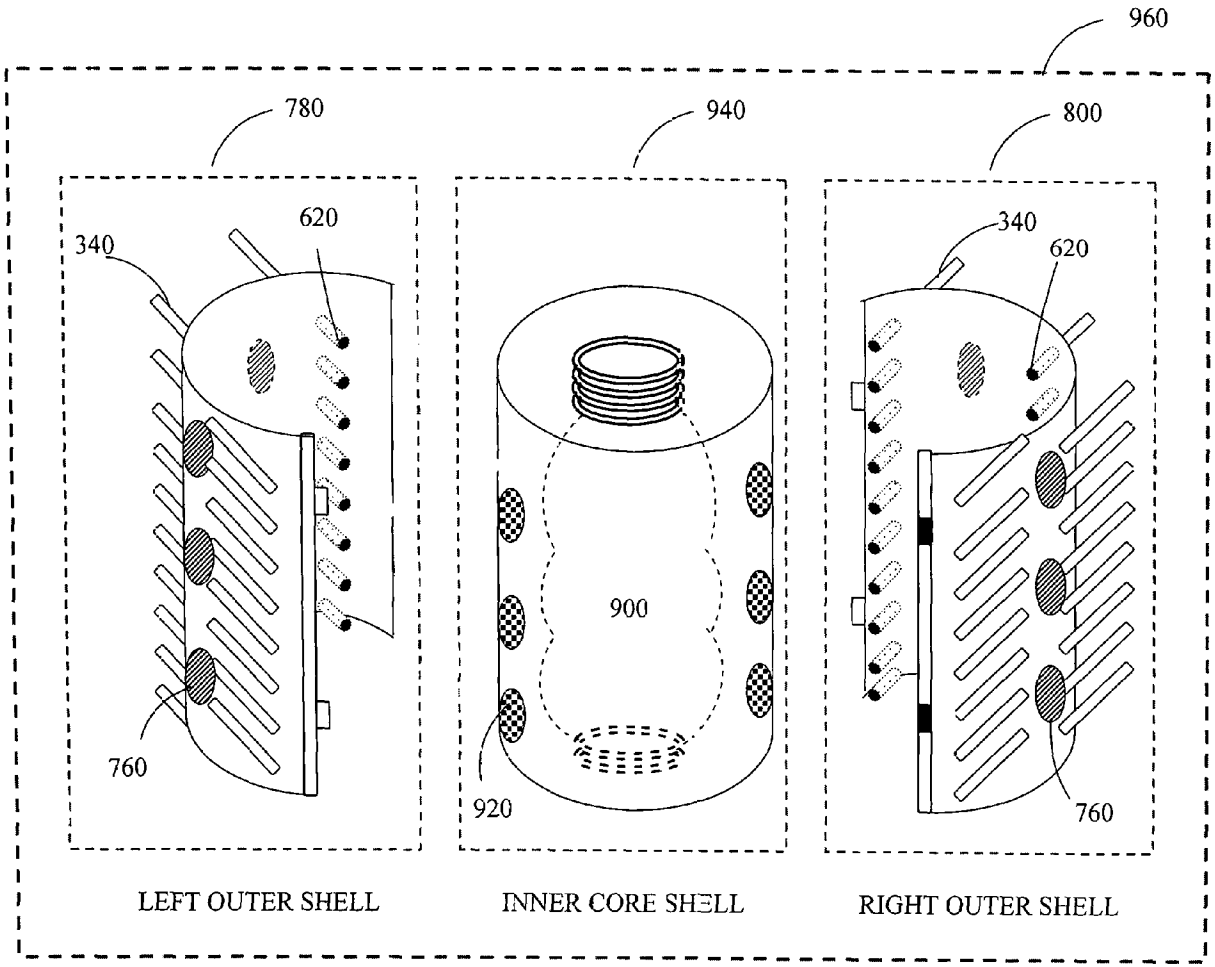
FIG. 5A illustrates a detachable vibrator structure (along with a detachable bristles' structure) and a detachable spray applicator of a bioactive compound/biologically active molecule or a mixture of bioactive compounds/biologically active molecules (in a liquid form) for growth and protection of hair.

FIG. 5A illustrates a detachable vibrator structure (along with a detachable bristles' structure) and a detachable spray applicator 960 of a bioactive compound/biologically active molecule or a mixture of bioactive compounds/biologically active molecules (in a liquid form) for growth and protection of hair, which includes (a) a left outer shell 780, (b) a right outer shell 800 and (c) an inner core shell 940.

Both the left outer shell 780 and right outer shell 800 has an array of bristles indicted by 340.

Furthermore, end of each bristle has a miniature magnet 620 for intimate attachment to the inner core shell 940.

Both the left outer shell 780 and right outer shell 800 has an array of holes indicated by 760.

The inner core shell has the detachable bag indicated by 900 with an array of holes indicated by 920.

Figure 5B:
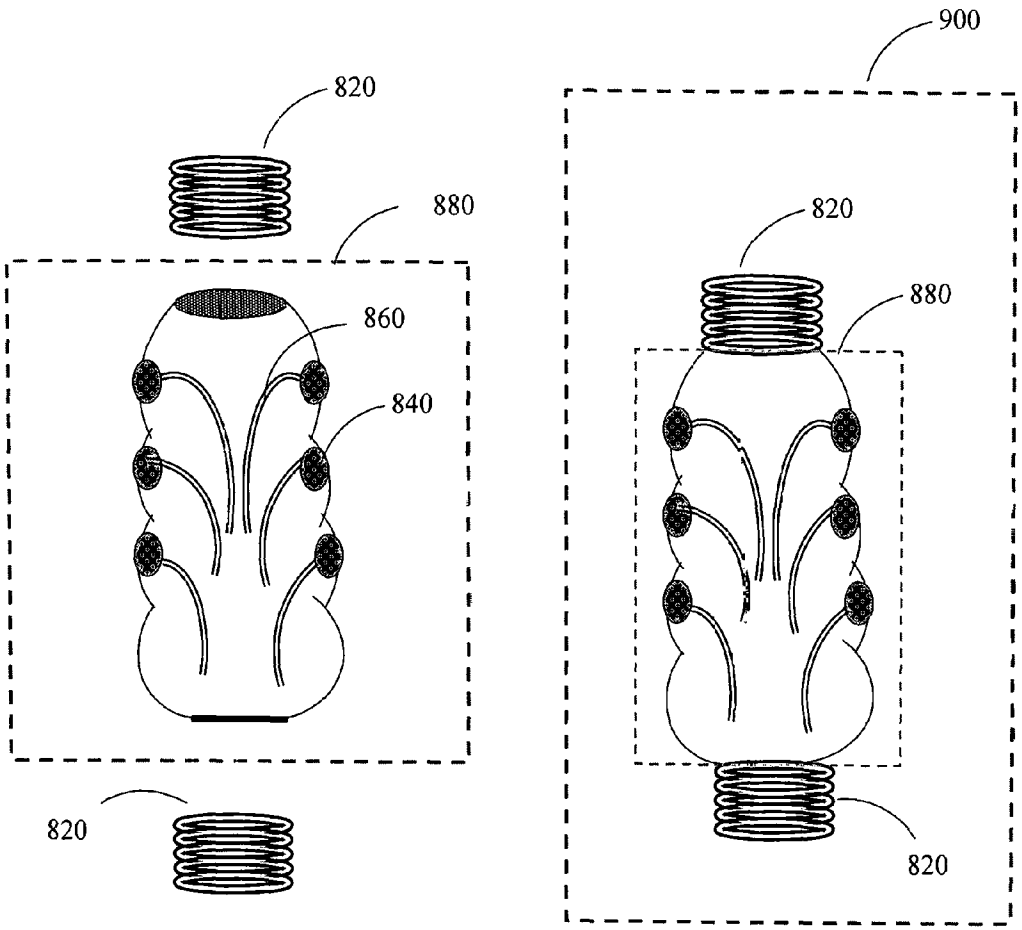
FIG. 5B illustrates an inner structure of a detachable spray applicator of a bioactive compound/biologically active molecule or a mixture of bioactive compounds/biologically active molecules (in a liquid form) for growth and protection of hair.

FIG. 5B illustrates the detachable bag 900. The detachable bag 900 has two metallic spring contacts 820 and an inner structure 880. The inner structure 880 has an array of holes indicated by 840 and an array of capillaries indicated by 860.

The metallic spring compresses to release a bioactive compound/biologically active molecule or a mixture of bioactive compounds/biologically active molecules (in liquid form) for growth and protection of hair through the holes indicated by 840, which are connected with array of capillaries indicated by 860.

Figure 5C:
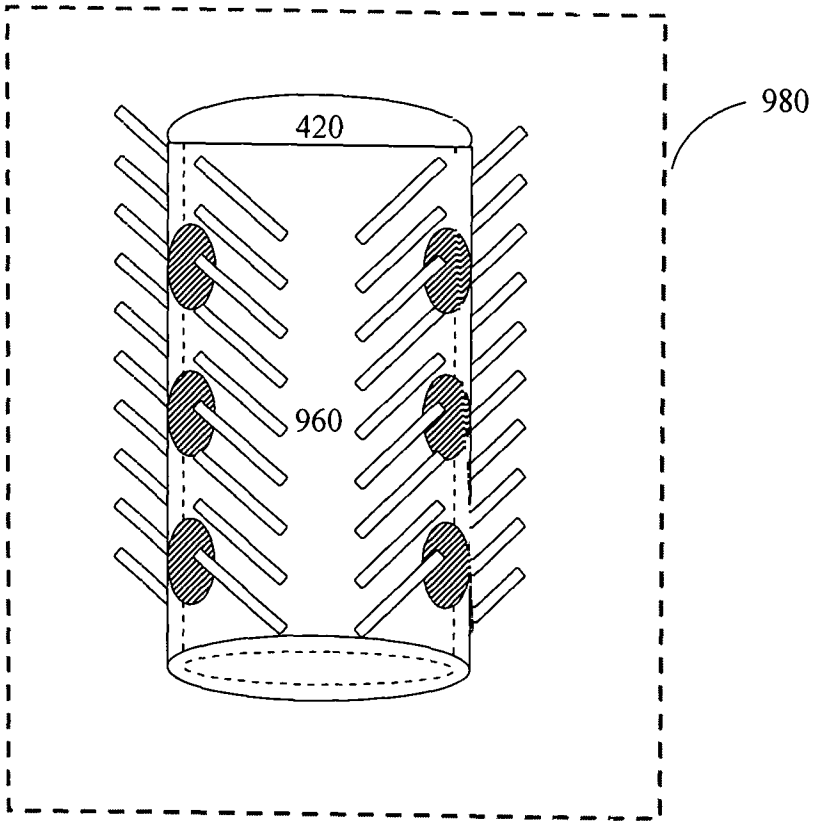
FIG. 5C illustrates a detachable second section, which includes (a) a detachable vibrator structure (along with a detachable bristles' structure) with a detachable spray applicator of a bioactive compound/biologically active molecule or a mixture of bioactive compounds/biologically active molecules (in a liquid form) for growth and protection of hair and (b) a detachable end cap.

FIG. 5C illustrates a detachable (integrated) second section 980, which includes (a) a detachable vibrator structure (along with a detachable bristles' structure) with a detachable spray applicator 960 of a bioactive compound/biologically active molecule or a mixture of bioactive compounds/biologically active molecules (in liquid form) for growth and protection of hair and (b) the detachable end cap 420.

By way of an example and not by way of any limitation, an example of a bioactive compound (extract/oil) for treatment against lice is: *Azadirachta indica, Cinnamomum zeylanicum, Lavendula angustifoli, Melaleuca alternifolia, Mentha piperita, Myristica fragrans, Pimpinella anisum, Pongamia glabra* and *Syzgium aromaticum.*

By way of an example and not by way of any limitation, an example of a mixture of bioactive compounds (extracts/oils) for treatment against lice is: 40 cc *Melaleuca alternifolia,* 20 cc *Pimpinella anisum* and 40 cc *Syzgium aromaticum.*

By way of an example and not by way of any limitation, an example of a bioactive compound (extract/oil) for treatment against dandruff is: *Azadirachta indica, Casytha filiformis, Curcuma longa, Eclipta alba, Emblica officinalis, Hibiscus rosa, Nyctanthes arbotristis, Pongamia glabra, Rubia cordifolia, Sesame indicum* and *Syzygium cumini.*

By way of an example and not by way of any limitation, an example of a mixture of bioactive compounds (extracts/oils) for treatment against dandruff is 10 cc *Argania spinosa* L, 10 cc *Calophyllum inophyllum,* 30 cc *Cocos nucifera,* 5 cc *Lavendula angustifolia,* 25 cc *Melaleuca alternifolia,* 5 cc *Syzgium aromaticum* and 15 cc *Syzygium cumini.*

However, the effectiveness of the above 100 cc mixture in the paragraph 95 can be improved by either oil-in-oil emulsion/nanoemulsion or oil-in-water emulsion/nanoemulsion. Furthermore, the oil-in-water nanoemulsion can be dried to form nanoparticles of the above 100 cc mixture.

By way of an example and not by way of any limitation, an example of a mixture of bioactive compounds (extracts/oils) for treatment of hair growth is: 10 cc *Camellia sinensis,* 10 cc *Centella asiatica,* 10 cc *Cocus nucifera,* 10 cc *Emblica officinalis,* 10 cc *Humulus lupulus,* 20 cc *Pisum sativum* (Pea) sprout, 10 cc *Salvia officinalis,* 10 cc *Scutellaria baicelensis* and 10 cc *Triticum vulgare* can be utilized for treatment against hair loss.

Furthermore, an extract/oil: 10 cc of *Aloe barbadensis* or *Argania spinosa* or *Avena sativa* or *Citrus paradisi* or *Glycine max* (soy) or *Olea lancifolia* or *Oryza sativa* or *Simmondsia chinensis* or *Vitis vinifera* extract/oil (10 cc) can be added to the above 100 cc mixture in the paragraph 97.

However, the effectiveness of the mixture, described in the paragraphs 97 to 98 can be improved by either oil-in-oil emulsion/nanoemulsion or oil-in-water emulsion/nanoemulsion. Furthermore, the oil-in-water nanoemulsion can be dried to form nanoparticles.

By way of an example and not by way of any limitation, an example of a mixture of bioactive compounds (extracts/oils) for treatment against grey hair is: 10 cc *Azadirachta indica,* 20 cc *Curcuma longa,* 10 cc *Eclipta alba,* 30 cc *Emblica officinalis,* 10 cc *Hibiscus rosa,* 10 cc *Pongamia glabra* and 10 cc *Sesame indicum.*

By way of an example and not by way of any limitation, a nanoshell can be a boron nitride nanotube, carbon nanotube, Cornell-dot, cubisome, dendrimer (including plant based dendrimer), deoxyribonucleic acid (DNA) origami nanostructure, ethosomes, exosome, fullerene $C_{60}$ (e.g., malonic acid derivative of $C_{60}$), gold nanoparticles (suitably coated), grapefruit-derived nanovector (GNV), hollow magnetic cage molecule (e.g., $Co_{12}C_6$, $Mn_{12}C_6$ and $Mn_{24}C_{18}$), lipidoid, liposome, mesoporous silica, micelle, nanocrystal, niosome, polysebacic acid (PSA), polysilsesquioxane (PSQ), porous silicon photonic crystal, quantum dot, quantum dot capped with glutathione, ribonucleic acid (RNA) origami nanostructure, self-assembling peptide (or self-assembling protein), solid-lipid nanoparticle, spherical nucleic acid (SNA), synthasome, tubular/tetrahedral structure fabricated/constructed, utilizing DNA/RNA origami process, virus, zein-plant protein and zeolite-1-nanocrystal.

A bioactive compound: minoxidil can be utilized for growth and protection of hair.

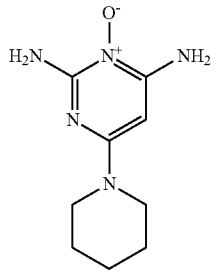

Furthermore, minoxidil with a suitable amount of retinoic acid (retin-A) can be utilized to enhance its synergetic effectiveness.

Furthermore, minoxidil with a suitable amount of vitamin A encapsulated or caged within a nanoshell can be utilized to enhance its synergetic effectiveness.

Minoxidil with a suitable amount of niacinamide encapsulated or caged within a nanoshell can be utilized to enhance its synergetic effectiveness.

Minoxidil with a suitable amount of pyrroloquinoline quinone (PQQ) encapsulated or caged within a nanoshell can be utilized to enhance its synergetic effectiveness.

Minoxidil with a suitable amount of resveratrol encapsulated or caged within a nanoshell can be utilized to enhance its synergetic effectiveness.

Minoxidil with suitable amounts of vitamin A and niacinamide encapsulated or caged within a nanoshell can be utilized to enhance its synergetic effectiveness.

Minoxidil with suitable amounts of vitamin A, niacinamide and pyrroloquinoline quinone (PQQ) encapsulated or caged within a nanoshell can be utilized to enhance its synergetic effectiveness.

Minoxidil with suitable amounts of vitamin A, niacinamide, pyrroloquinoline quinone (PQQ) and resveratrol encapsulated or caged within a nanoshell can be utilized to enhance its synergetic effectiveness.

A bioactive compound: bimatoprost can be utilized for growth and protection of hair.

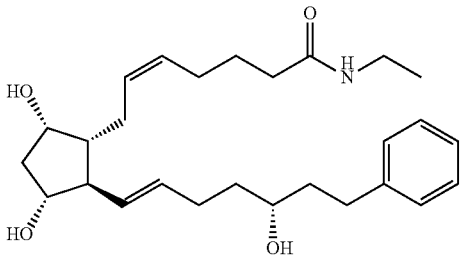

Furthermore, bimatoprost with a suitable amount of vitamin A encapsulated or caged within a nanoshell can be utilized to enhance its synergetic effectiveness.

Bimatoprost with a suitable amount of niacinamide encapsulated or caged within a nanoshell can be utilized to enhance its synergetic effectiveness.

Bimatoprost with a suitable amount of pyrroloquinoline quinone (PQQ) encapsulated or caged within a nanoshell can be utilized to enhance its synergetic effectiveness.

Bimatoprost with a suitable amount of resveratrol encapsulated or caged within a nanoshell can be utilized to enhance its synergetic effectiveness.

Bimatoprost with suitable amounts of vitamin A and niacinamide encapsulated or caged within a nanoshell can be utilized to enhance its synergetic effectiveness.

Bimatoprost with suitable amounts of vitamin A, niacinamide and pyrroloquinoline quinone (PQQ) encapsulated or caged within a nanoshell can be utilized to enhance its synergetic effectiveness.

Bimatoprost with suitable amounts of vitamin A, niacinamide, pyrroloquinoline quinone (PQQ) and resveratrol encapsulated or caged within a nanoshell can be utilized to enhance its synergetic effectiveness.

Bimatoprost with suitable amounts of vitamin A, niacinamide, pyrroloquinoline quinone (PQQ), resveratrol and minoxidil encapsulated or caged within a nanoshell can be utilized to enhance its synergetic effectiveness.

A bioactive compound: tofacitinib (tofacitinib citrate) can be utilized for growth and protection of hair.

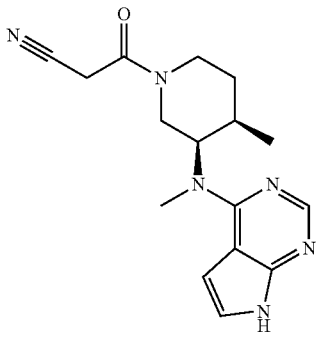

Furthermore, tofacitinib with a suitable amount of vitamin A encapsulated or caged within a nanoshell can be utilized to enhance its synergetic effectiveness.

Tofacitinib with a suitable amount of niacinamide encapsulated or caged within a nanoshell can be utilized to enhance its synergetic effectiveness.

Tofacitinib with a suitable amount of pyrroloquinoline quinone (PQQ) encapsulated or caged within a nanoshell can be utilized to enhance its synergetic effectiveness.

Tofacitinib with a suitable amount of resveratrol encapsulated or caged within a nanoshell can be utilized to enhance its synergetic effectiveness.

Tofacitinib with suitable amounts of vitamin A and niacinamide encapsulated or caged within a nanoshell can be utilized to enhance its synergetic effectiveness.

Tofacitinib with suitable amounts of vitamin A, niacinamide and pyrroloquinoline quinone (PQQ) encapsulated or caged within a nanoshell can be utilized to enhance its synergetic effectiveness.

Tofacitinib with suitable amounts of vitamin A, niacinamide, pyrroloquinoline quinone (PQQ) and resveratrol encapsulated or caged within a nanoshell can be utilized to enhance its synergetic effectiveness.

Tofacitinib with suitable amounts of vitamin A, niacinamide, pyrroloquinoline quinone (PQQ), resveratrol and minoxidil encapsulated or caged within a nanoshell can be utilized to enhance its synergetic effectiveness.

Tofacitinib with suitable amounts of vitamin A, niacinamide, pyrroloquinoline quinone (PQQ), resveratrol and bimatoprost encapsulated or caged within a nanoshell can be utilized to enhance its synergetic effectiveness.

A bioactive compound: ruxolitinib can be utilized for growth and protection of hair.

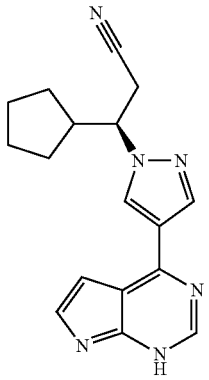

Furthermore, ruxolitinib with a suitable amount of vitamin A encapsulated or caged within a nanoshell can be utilized to enhance its synergetic effectiveness.

Ruxolitinib with a suitable amount of niacinamide encapsulated or caged within a nanoshell can be utilized to enhance its synergetic effectiveness.

Ruxolitinib with a suitable amount of pyrroloquinoline quinone (PQQ) encapsulated or caged within a nanoshell can be utilized to enhance its synergetic effectiveness.

Ruxolitinib with a suitable amount of resveratrol encapsulated or caged within a nanoshell can be utilized to enhance its synergetic effectiveness.

Ruxolitinib with suitable amounts of vitamin A and niacinamide encapsulated or caged within a nanoshell can be utilized to enhance its synergetic effectiveness.

Ruxolitinib with suitable amounts of vitamin A, niacinamide and pyrroloquinoline quinone (PQQ) encapsulated or caged within a nanoshell can be utilized to enhance its synergetic effectiveness.

Ruxolitinib with suitable amounts of vitamin A, niacinamide, pyrroloquinoline quinone (PQQ) and resveratrol encapsulated or caged within a nanoshell can be utilized to enhance its synergetic effectiveness.

Ruxolitinib with suitable amounts of vitamin A, niacinamide, pyrroloquinoline quinone (PQQ), resveratrol and minoxidil encapsulated or caged within a nanoshell can be utilized to enhance its synergetic effectiveness.

Ruxolitinib with suitable amounts of vitamin A, niacinamide, pyrroloquinoline quinone (PQQ), resveratrol and bimatoprost encapsulated or caged within a nanoshell can be utilized to enhance its synergetic effectiveness.

Ruxolitinib and tofacitinib with a suitable amount of vitamin A encapsulated or caged within a nanoshell can be utilized to enhance its synergetic effectiveness.

Ruxolitinib and tofacitinib with a suitable amount of niacinamide encapsulated or caged within a nanoshell can be utilized to enhance its synergetic effectiveness.

Ruxolitinib and tofacitinib with a suitable amount of pyrroloquinoline quinone (PQQ) encapsulated or caged within a nanoshell can be utilized to enhance its synergetic effectiveness.

Ruxolitinib and tofacitinib with a suitable amount of resveratrol encapsulated or caged within a nanoshell can be utilized to enhance its synergetic effectiveness.

Ruxolitinib and tofacitinib with suitable amounts of vitamin A and niacinamide encapsulated or caged within a nanoshell can be utilized to enhance its synergetic effectiveness.

Ruxolitinib and tofacitinib with suitable amounts of vitamin A, niacinamide and pyrroloquinoline quinone (PQQ) encapsulated or caged within a nanoshell can be utilized to enhance its synergetic effectiveness.

Ruxolitinib and tofacitinib with suitable amounts of vitamin A, niacinamide, pyrroloquinoline quinone (PQQ) and resveratrol encapsulated or caged within a nanoshell can be utilized to enhance its synergetic effectiveness.

Ruxolitinib and tofacitinib with suitable amounts of vitamin A, niacinamide, pyrroloquinoline quinone (PQQ), resveratrol and minoxidil encapsulated or caged within a nanoshell can be utilized to enhance its synergetic effectiveness.

Ruxolitinib and tofacitinib with suitable amounts of vitamin A, niacinamide, pyrroloquinoline quinone (PQQ), resveratrol and bimatoprost encapsulated or caged within a nanoshell can be utilized to enhance its synergetic effectiveness.

A bioactive compound: antiandrogen RU 58841 can be utilized for growth and protection of hair.

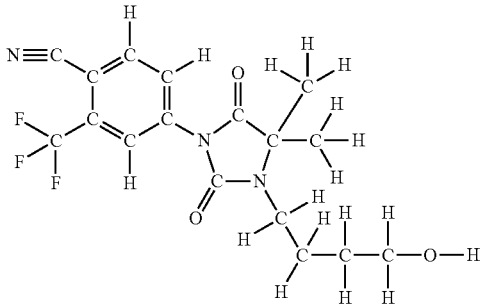

RU 58841

Furthermore, antiandrogen RU 58841 with a suitable amount of vitamin A encapsulated or caged within a nanoshell can be utilized to enhance its synergetic effectiveness.

Antiandrogen RU 58841 with a suitable amount of niacinamide encapsulated or caged within a nanoshell can be utilized to enhance its synergetic effectiveness.

Antiandrogen RU 58841 with a suitable amount of pyrroloquinoline quinone (PQQ) encapsulated or caged within a nanoshell can be utilized to enhance its synergetic effectiveness.

Antiandrogen RU 58841 with a suitable amount of resveratrol encapsulated or caged within a nanoshell can be utilized to enhance its synergetic effectiveness.

Antiandrogen RU 58841 with suitable amounts of vitamin A and niacinamide encapsulated or caged within a nanoshell can be utilized to enhance its synergetic effectiveness.

Antiandrogen RU 58841 with suitable amounts of vitamin A, niacinamide and pyrroloquinoline quinone (PQQ) encapsulated or caged within a nanoshell can be utilized to enhance its synergetic effectiveness.

Antiandrogen RU 58841 with suitable amounts of vitamin A, niacinamide, pyrroloquinoline quinone (PQQ) and resveratrol encapsulated or caged within a nanoshell can be utilized to enhance its synergetic effectiveness.

Antiandrogen RU 58841 with suitable amounts of vitamin A, niacinamide, pyrroloquinoline quinone (PQQ), resveratrol and minoxidil encapsulated or caged within a nanoshell can be utilized to enhance its synergetic effectiveness.

Antiandrogen RU 58841 with suitable amounts of vitamin A, niacinamide, pyrroloquinoline quinone (PQQ), resveratrol and bimatoprost encapsulated or caged within a nanoshell can be utilized to enhance its synergetic effectiveness.

Antiandrogen RU 58841 with suitable amounts of vitamin A, niacinamide, pyrroloquinoline quinone (PQQ), resveratrol and tofacitinib encapsulated or caged within a nanoshell can be utilized to enhance its synergetic effectiveness.

Antiandrogen RU 58841 with suitable amounts of vitamin A, niacinamide, pyrroloquinoline quinone (PQQ), resveratrol and ruxolitinib encapsulated or caged within a nanoshell can be utilized to enhance its synergetic effectiveness.

Astressin-B peptide can block receptors for corticotropin-releasing factor, involved in the stress response. Thus Astressin-B peptide can be beneficial for growth and protection of hair.

The Wnt signaling pathways are a group of signal transduction pathways made of proteins that pass signals from outside of a cell through cell surface receptors to the inside of the cell. Activation of Wnt signaling in a safe and controlled way by *Aconiti ciliare Tuber* extract, can be beneficial for growth and protection of hair.

A mixture of about 200 mg of catalase (or a chemical derivate or a structural analog of catalase or a pseudocatalase activated via sunlight), about 200 mg of glutathione peroxidase, about 1000 mg of L-methionine, about 100 mg of methionine sulfoxide reductase (MSR), about 200 mcg of selenium amino acid complex (sodium selenite, L-selenomethionin and selenium-methyl L-selenocysteine), about 200 mg superoxide dismutase (SOD), about 15 mg of zinc (L-Opti) and about 200 mg of *Emblica officinalis* extract can be beneficial for growth and protection of hair.

Similarly, a mixture of about 200 mg of catalase (or a chemical derivate or a structural analog of catalase or a pseudocatalase activated via sunlight), about 20 mg of niacin or 100 mg niacinamide, about 20 mg pyrroloquinoline quinone (PQQ), about 200 mg resveratrol, about 200 mg superoxide dismutase (SOD), about 1000 IU vitamin A, about 200 mcg vitamin H and about 15 mg zinc can be beneficial for growth and protection of hair.

Furthermore, a mixture of extracts or oils, about 10 cc *Aconiti ciliare Tuber*, about 10 cc *Centella asiatica*, about 20 cc *Emblica officinalis*, about 10 cc *Humulus lupulus*, about 30 cc *Pisum sativum* sprout, about 10 cc *Scutellaria baicelensis* and about 10 cc *Triticum vulgare* can be beneficial for growth and protection of hair.

It should be noted that niacinamide can be substituted with a suitable amount of niacin.

Furthermore a bioactive compound or a biologically active molecule or a mixture of bioactive compounds and/or biologically active molecules can be sprayed by the detachable spray applicator 960, followed by hair/scalp massaging and low intensity light activation.

Figure 5D:
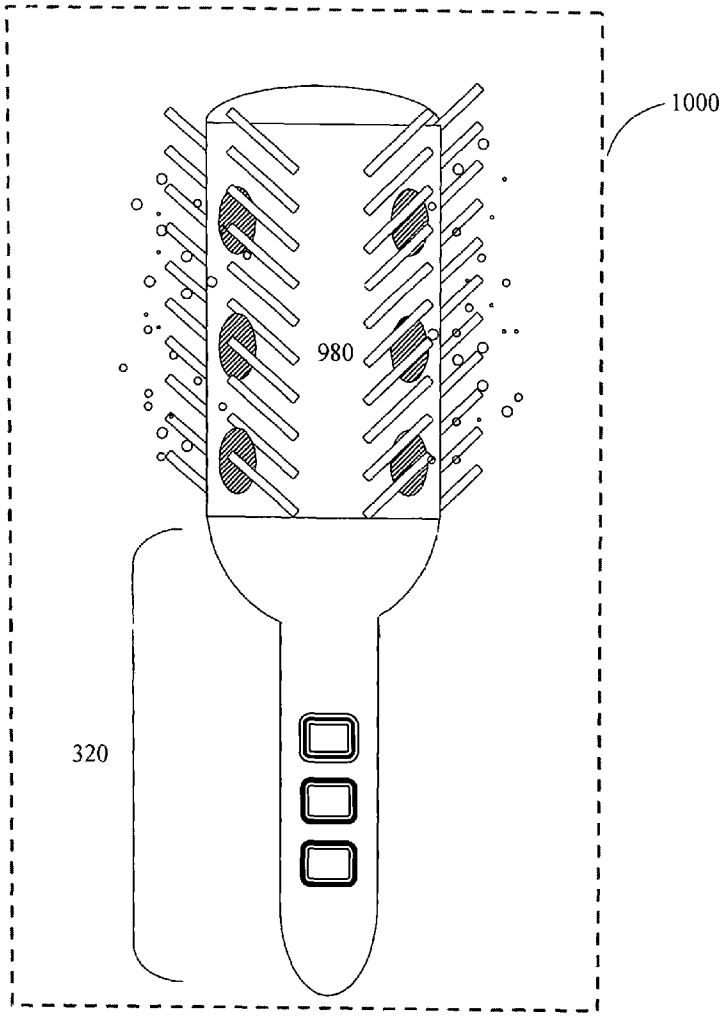
FIG. 5D illustrates a hairbrush, which includes (a) a detachable first section, (b) a detachable second section. The detachable second section, which includes (a) a detachable vibrator structure (along with a detachable bristles' structure) with a detachable spray applicator of a bioactive compound/biologically active molecule or a mixture of bioactive compounds/biologically active molecules (in a liquid form) for growth and protection of hair.

FIG. 5D illustrates a hairbrush 1000, which includes (a) the detachable first section 320 and (b) the detachable (integrated) second section 980.

Figure 6A:
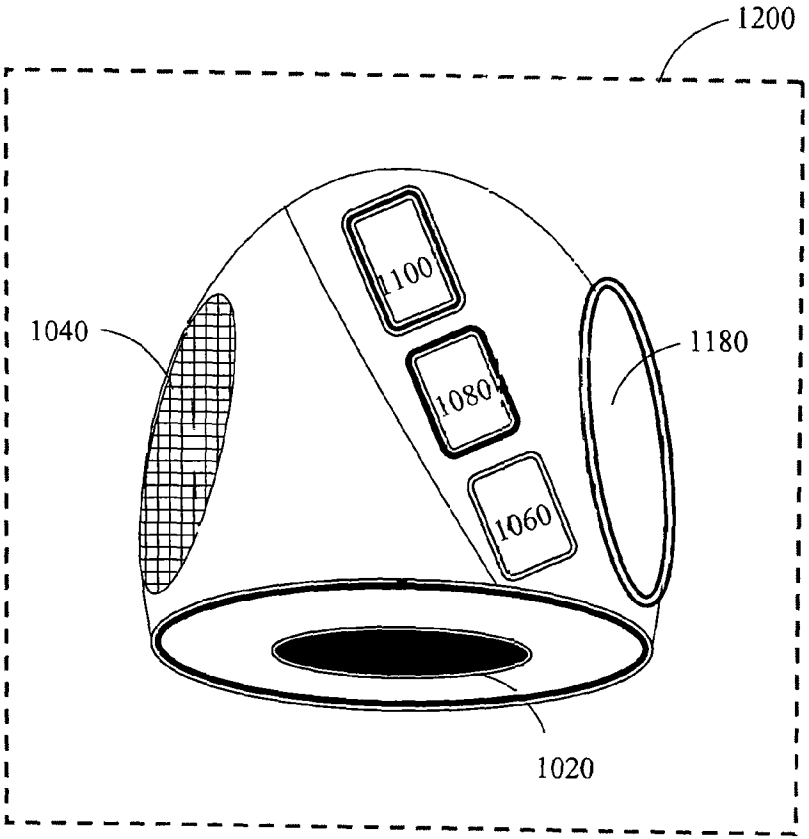
FIG. 6A illustrates a detachable section as a hair dryer.

FIG. 6A illustrates a detachable section as a hair dryer 1200, which includes a metallic contact area indicated by 1020, a mesh area indicated by 1040, a power (on/off) indicator 1060, moderate airflow indicator 1080 and high airflow indicator 1100.

The detachable section as a hair dryer 1200 includes a subsystem 1180 integrated with a fan and a heater.

Figure 6B:
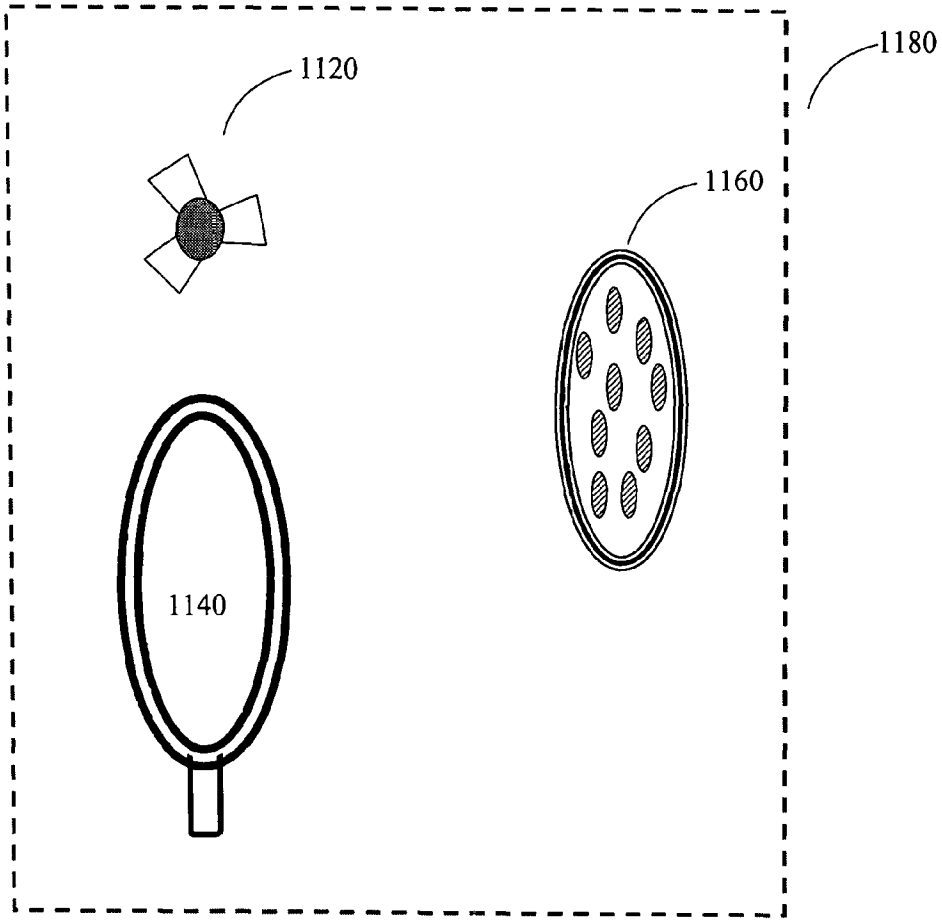
FIG. 6B illustrates a subsystem integrated with a fan and a heater within the detachable section as a hair dryer.

FIG. 6B illustrates a subsystem 1180 integrated with a fan and a heater. This subsystem 1180 is integrated with a blade fan 1120 or a bladeless fan 1140 and a heater 1160.

A conventional fan relies on fan blades to chop the air and push it forward, but a bladeless fan utilizes an airflow dynamics. Air is pulled into the bladeless fan's cylindrical base, utilizing a small brushless motor. The motor's impeller pushes air into a hollow ring and air is then forced out slits, wherein the slits are located all around the hollow ring. The air is then accelerated into a circular motion.

However, the heater 1160 can be a resistive heater or an electromagnetic heater.

Figure 6C:
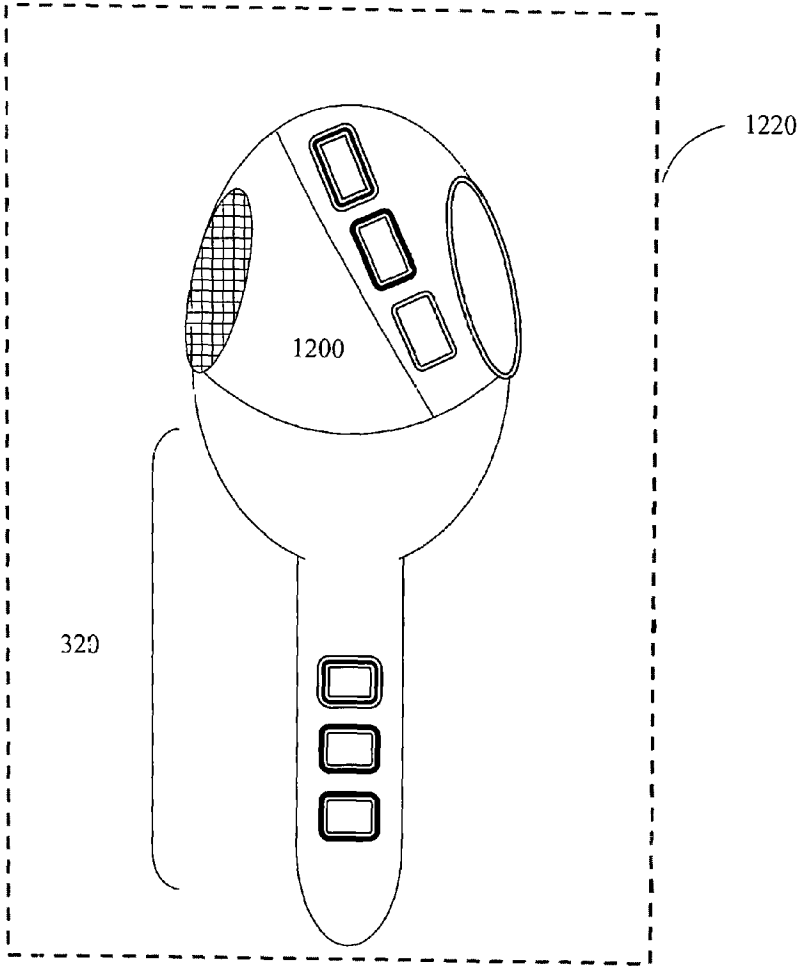
FIG. 6C illustrates a hairbrush, which includes (a) a detachable first section and (b) a detachable hair dryer.

FIG. 6C illustrates a hairbrush 1220, which has (a) the detachable first section 320 and (b) the detachable hair dryer 1200.

Figure 7A:
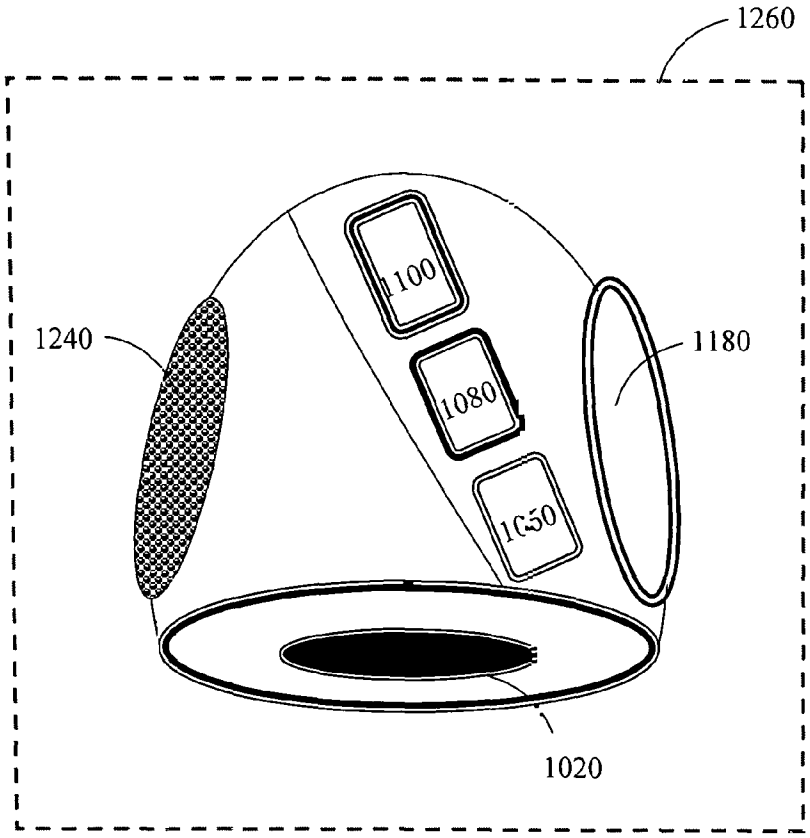
FIG. 7A illustrates a detachable low intensity light module.

FIG. 7A illustrates a detachable end cap 1260 with a low intensity light module 1240. The low intensity light module 1240 has an array of vertical cavity surface emitting lasers or an array of light emitting diodes of a suitable wavelength range.

Figure 7B:
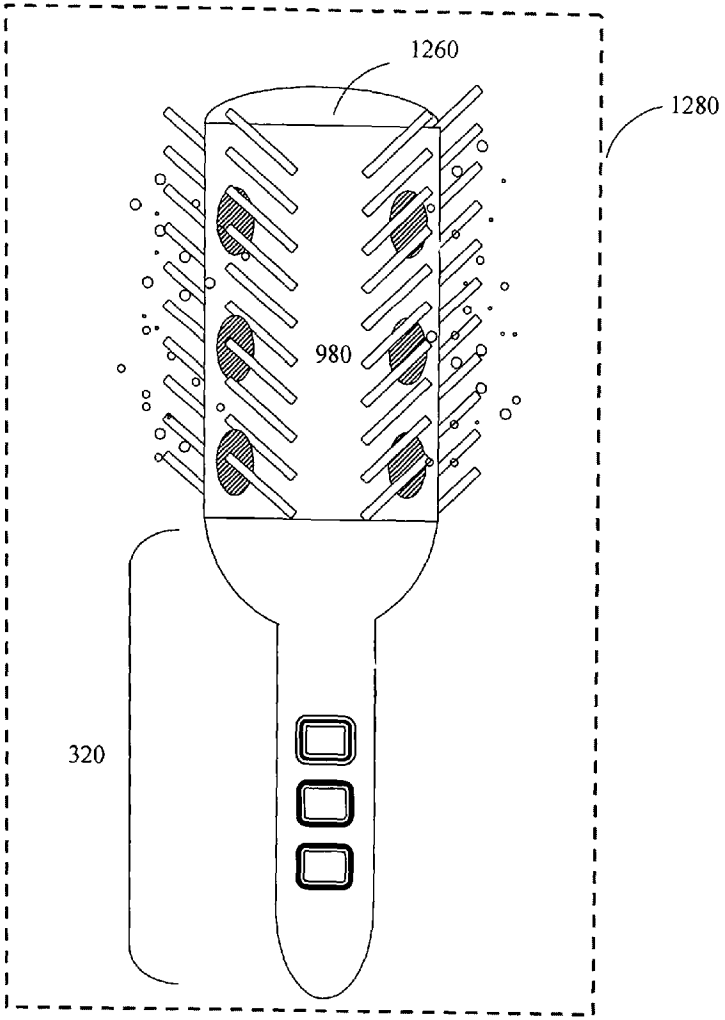
FIG. 7B illustrates a hairbrush, which includes (a) a detachable first section, (b) a detachable second section and (c) a detachable low intensity light module. The detachable second section, which includes (a) a detachable vibrator structure (along with a detachable bristles' structure) with a detachable spray applicator of a bioactive compound/biologically active molecule or a mixture of bioactive compounds/biologically active molecules (in a liquid form) for growth and protection of hair.

FIG. 7B illustrates a hairbrush 1280, which has (a) a detachable first section 320, (b) a detachable second section and (c) a detachable low intensity light module 1260. The detachable second section, which includes (a) a detachable vibrator structure (along with a detachable bristles' structure) with a detachable spray applicator of a bioactive compound/biologically active molecule or a mixture of bioactive compounds/biologically active molecules (in a liquid form) for growth and protection of hair.

Wavelengths in the 600-700 nm (red) range are chosen for shallow penetration and wavelengths in the 780-950 nm (NIR) are chosen for deeper penetration. Wavelengths in the 700-770 nm are not considered to have much photoactivity. The low intensity light module 1240 can induce photoactivation on a bioactive compound/biologically active molecule.

A dose in the 600-700 nm (red) wavelengths for shallow penetration can be in the range of 1-10 J/cm$^2$.

A dose in the 780-950 nm (NIR) wavelengths for deeper penetration can be in the range of 1-50 J/cm$^2$.

The low intensity light module 1240 can combine both 600-700 nm (red) wavelengths and 780-950 nm (NIR) wavelengths for synergistic effects.

Furthermore, lower pulse rate (e.g., 2 Hz, as opposed to 10 Hz) and polarization of the low intensity light module 1240 can be beneficial.

It should be noted that low intensity light activation of a bioactive compound/biologically active molecule or a mixture of bioactive compounds/biologically active molecules (delivered by a spray applicator or by a scaffold onto live biological cells) can be utilized for other therapeutic applications (e.g., arthritis, skin rejuvenation and wound care).

Three-Dimensional (3-D) Printing of the Multifunctional Hairbrush

The three-dimensional (3-D) printing is an additive process, which means that a three-dimensional (3-D) solid object can be formed by adding material in layers. This is in sharp contrast to current subtractive process, through which an object is formed by cutting/machining material into a desired shape. After a computer aided design (CAD) file is sent to a three-dimensional (3-D) printer, one can choose a set of specific materials (e.g., composites, metals and plastic). In the three-dimensional (3-D) printing, the materials are usually sprayed, squeezed or otherwise transferred from the three-dimensional (3-D) printer onto a platform. Then, the three-dimensional (3-D) printer makes passes (like an inkjet printer) over the platform, depositing material layer on top of material layer to create the various embodiments of the hairbrush with or without a hair dryer.

The average thickness of a three-dimensional (3-D) printed layer is about 15 microns (μm) to 100 microns (μm).

Figure 8:
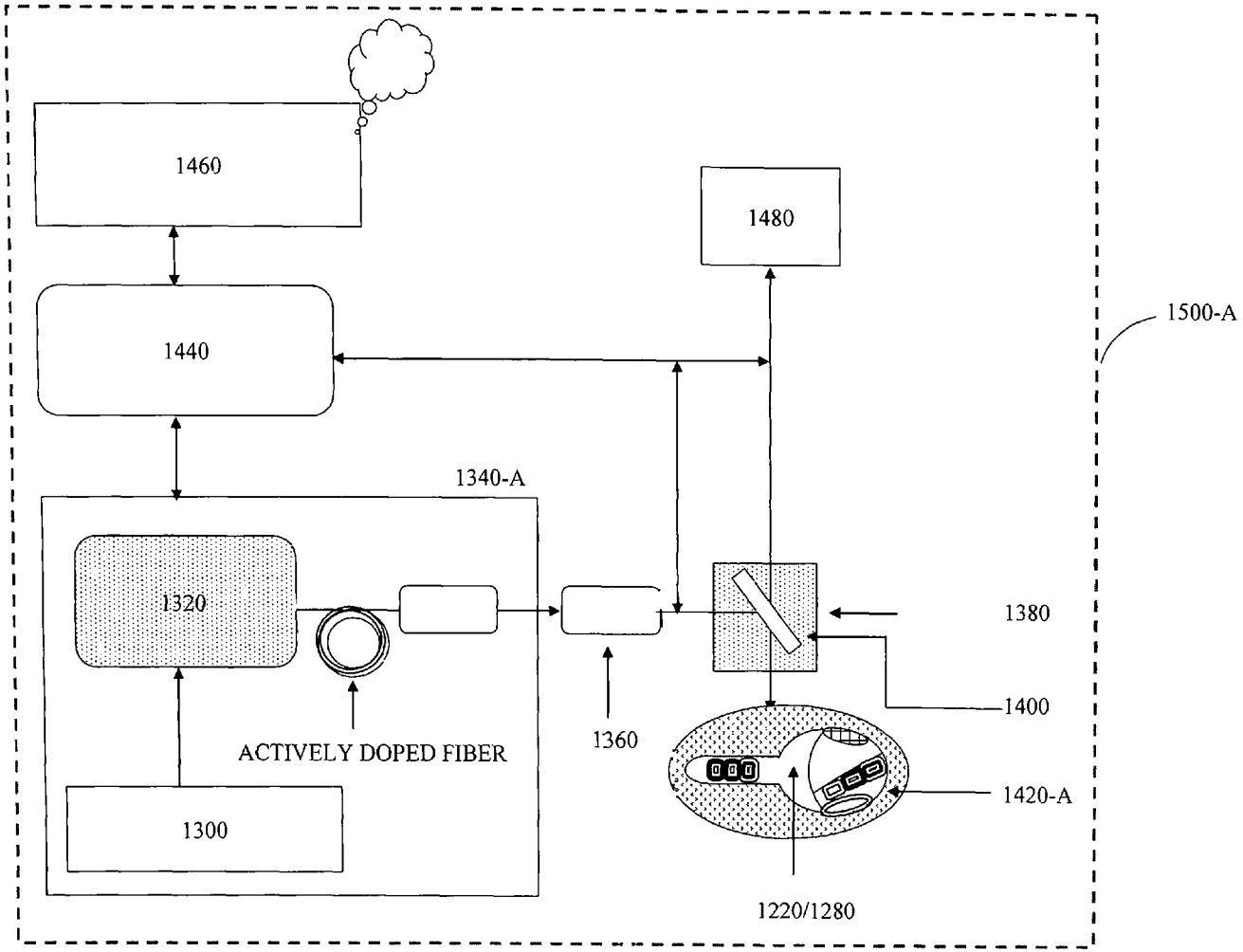
FIG. 8 illustrates a fast three-dimensional (3-D) printer for printing the multifunctional hairbrush.

FIG. 8 illustrates a fast three-dimensional (3-D) printer 1500-A for realizing the multifunctional hairbrush 1220 or 1280. A high power (100 watts to 1000 watts) master oscillator power amplifier (MOPA) based short pulse fiber laser 1340-A is enabled by an actively doped fiber, a MOPA module 1320 and a 980 nm pump laser module 1300. The high power laser beam is expanded by a beam expander 1360 and the laser beam is divided by a beam splitter 1400. The laser beam is preciously positioned by a scanning stage 1380 onto a material tray (with a roller and a larger diameter input nozzle) 1420-A.

Fast three-dimensional (3-D) printing is enabled by (a) larger diameter nozzle (about 0.20 inch in diameter instead of 0.020 inch in diameter) and (b) higher power pulsed fiber laser. Larger diameter nozzle can enable to lay down more material and higher power pulsed fiber laser can print more material layer-thus, resulting in a fast three-dimensional (3-D) printer. Backward propagated laser beam from the beam splitter 1400 can be imaged by a CCD camera 1480 for in-situ process inspection. The laser beam from the fiber laser 1340-A and the scanning stage 1380 are controlled by a controller 1440. Furthermore, the computer aided design (CAD) file can be verified and authenticated (against any misuse of intellectual property rights) by a centralized database stored in a cloud based computer 1460.

Three-Dimensional (3-D) Printing of a Scaffold

Figure 9:
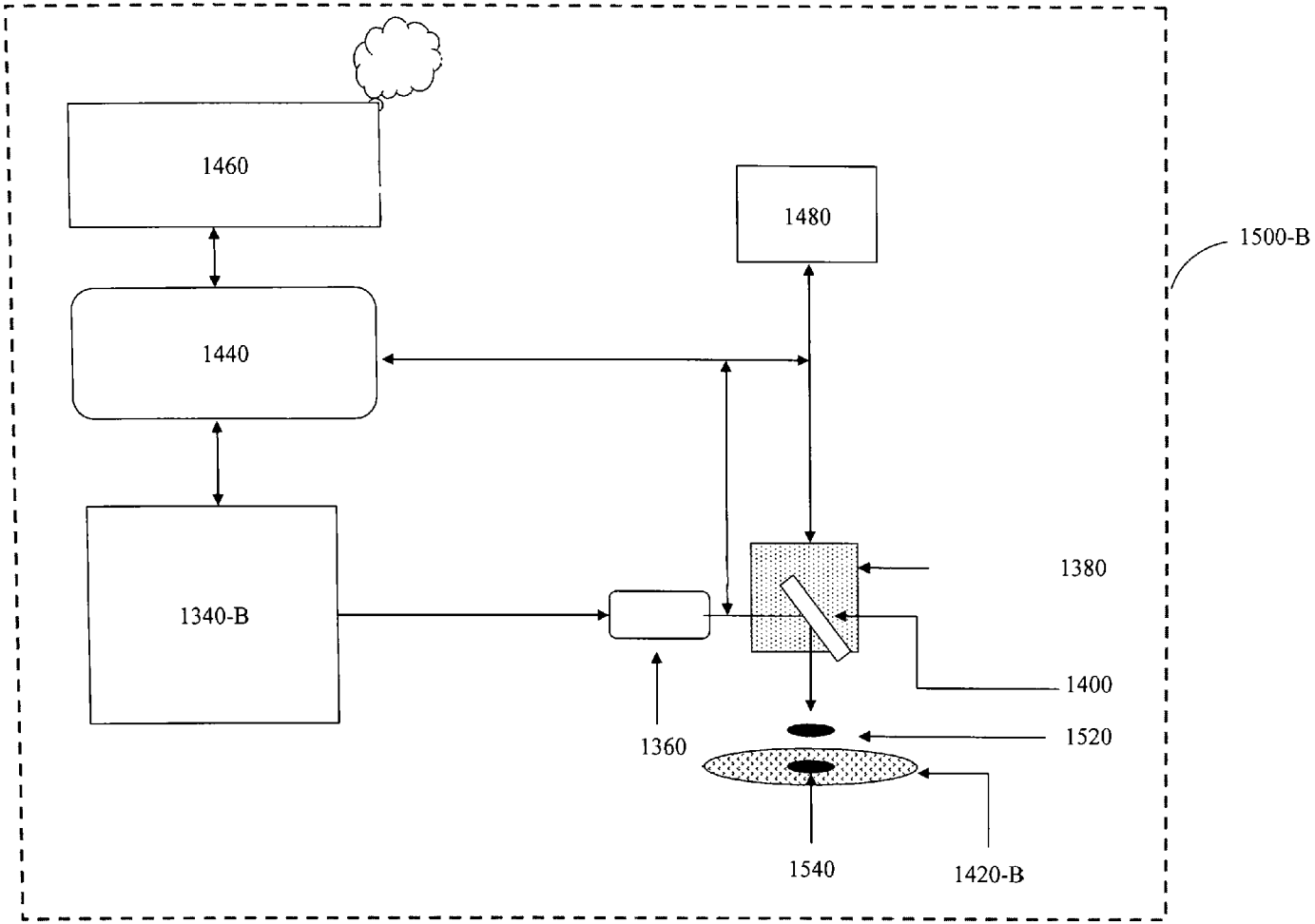
FIG. 9 illustrates a three-dimensional (3-D) printer for printing a scaffold.

FIG. 9 illustrates a two-photon based three-dimensional (3-D) printer 1500-B for realizing a scaffold 1540. In many aspects, a two-photon based three-dimensional (3-D) printer 1500-B is similar to the three-dimensional (3-D) printer 1500-A. The two-photon based three-dimensional (3-D) printer 1500-B utilizes a super high resolution femtosecond laser 1340-B, a microscope objective 1520 and a tray 1420-B for photosensitive (biocompatible) material. Molecules in the photosensitive (biocompatible) material can harden to form a scaffold 1540, when these molecules absorb two photons from the super high resolution femtosecond laser 1340-B.

The average thickness of a two-photon based three-dimensional (3-D) printed layer is about 100 nm.

The scaffolds 1540 can contain a bioactive compound/biologically active molecule or a mixture of bioactive compounds/biologically active molecules for growth and protection of hair.

Furthermore, the bioactive compound/biologically active molecule or the mixture of bioactive compounds/biologically active molecules for growth and protection of hair can be encapsulated or caged within a nanoshell.

Furthermore, the bioactive compound/biologically active molecule or the mixture of bioactive compounds/biologically active molecules for growth and protection of hair can be prepared as an emulsion or a nanoemulsion.

It should be noted that the scaffold 1540 (fabricated in a photosensitive biocompatible material) can be attached to biological cells, printed biological cells (e.g., blood vessels formed by printing artificial biological molecules with a three-dimensional (3-D) inkjet bioprinter and then shaped by a laser beam) or live biological cells, wherein the scaffold suitably contains a bioactive compound/biologically active molecule or a mixture of bioactive compounds/biologically active molecules for growth and protection of hair.

In the above disclosed specifications "/" has been used to indicate an "or". Any example in the above disclosed specifications is by way of an example only and not by way of any limitation.

The above disclosed specifications are the preferred best mode embodiments of the present invention. However, they are not intended to be limiting only to the preferred best mode embodiments of the present invention. Numerous variations and/or modifications are possible within the scope of the present invention. Accordingly, the disclosed preferred best mode embodiments are to be construed as illustrative only. Those who are skilled in the art can make various variations and/or modifications (e.g., a light source can be utilized instead of a laser, when it is applicable) without departing from the scope and spirit of this invention. The inventors of the present invention are not required to describe each and every conceivable and possible future embodiment in the preferred best mode embodiments of the present invention. See *SRI Int'l v. Matsushita Elec. Corp. of America,* 775F.2d 1107, 1121, 227 U.S.P.Q. (BNA) 577, 585 (Fed. Cir. 1985) (enbanc).

Thus, the scope and spirit of this invention shall be defined by the claims and the equivalents of the claims only. The exclusive use of all variations and/or modifications within the scope of the claims is reserved. Unless a claim term is specifically defined in the preferred best mode embodiments, then a claim term has ordinary meaning, as understood by a person with an ordinary skill in the art (e.g., a BS with 3 years of experience in the art), at the time of the present invention. As noted long ago: "Specifications teach. Claims claim". See *Rexnord Corp. v. Laitram Corp.,* 274 F.3d 1336, 1344 (Fed. Cir. 2001). Furthermore, the rights of claims (and rights of the equivalents of the claims under the Doctrine of Equivalents-meeting the "Triple Identity Test" (*a*) performing substantially the same function, (b) in substantially the same way and (c) yielding substantially the same result See *Crown Packaging Tech., Inc. v. Rexam Beverage Can Co.,* 559 F.3d 1308, 1312 (Fed. Cir. 2009)) of the present invention are not narrowed or limited by the selective import of the specifications (of the preferred embodiments of the present invention) into the claims.

I claim:

1. An apparatus comprising:

(a) an applicator to spray a bioactive compound or a liquid for growth or protection of hair,
wherein the applicator comprises an ultrasonic wave generator or a vibrator,
wherein the applicator is activated or set in motion by the ultrasonic wave generator or the vibrator;

(b) a light module,
wherein the light module activates the bioactive compound or the liquid for growth or protection of hair,
wherein the light module provides:
a dose in the range from 1 J/cm$^2$ to 10 J/cm$^2$ in 600-700 nm wavelength range,
or
a dose in the range from 1 J/cm$^2$ to 50 J/cm$^2$ in 780-950 nm wavelength range; and (c) a massaging device for hair or scalp, wherein the massaging device comprises bristles.

2. The apparatus according to claim 1, further comprising an inductively coupled wireless electrical charger or a wired electrical charger.

3. The apparatus according to claim 1, further comprising the bioactive compound, wherein the bioactive compound is selected from the group consisting of: pyrroloquinoline quinone (PQQ), resveratrol, vitamin A, vitamin H and zinc.

4. The apparatus according to claim 1, further comprising the bioactive compound, wherein the bioactive compound is selected from the group consisting of: antiandrogen RU 58841, astressin-B, bimatoprost, minoxidil, ruxolitinib and tofacitinib.

5. The apparatus according to claim 1, further comprising the bioactive compound wherein the bioactive compound is selected from the group consisting of: catalase, niacinamide and superoxide dismutase (SOD), wherein niacinamide can be substituted with niacin.

6. The apparatus according to claim 1, further comprising the bioactive compound in an emulsion or the bioactive compound encapsulated in a nanoshell.

7. The apparatus according to claim 1, further comprising the liquid, wherein the liquid comprises a botanical extract or a botanical extract in an emulsion.

8. An apparatus comprising:

(a) an applicator to spray a botanical extract or a liquid for growth or protection of hair,
wherein the applicator comprises an ultrasonic wave generator or a vibrator,
wherein the applicator is activated or set in motion by the ultrasonic wave generator or the vibrator;

(b) a light module,
wherein the light module activates the botanical extract or the liquid for growth or protection of hair,
wherein the light module provides:
a dose in the range from 1 J/cm$^2$ to 10 J/cm$^2$ in 600-700 nm wavelength range,
or
a dose in the range from 1 J/cm$^2$ to 50 J/cm$^2$ in 780-950 nm wavelength range; and (c) a massaging device for hair or scalp, wherein the massaging device comprises bristles.

9. The apparatus according to claim 8, further comprising an inductively coupled wireless electrical charger or a wired electrical charger.

10. The apparatus according to claim 8, further comprising the botanical extract, wherein the botanical extract is selected from the group consisting of: *Aconiti ciliare Tuber, Emblica officinalis, Humulus lupulus* and *Pisum sativum* sprout.

11. The apparatus according to claim 8, further comprising the liquid, wherein the liquid comprises a bioactive compound in an emulsion or a bioactive compound encapsulated in a nanoshell.

12. The apparatus according to claim 8, further comprising the botanical extract in an emulsion.

13. An apparatus comprising:

(a) an applicator to spray a bioactive compound or a liquid for growth or protection of hair, wherein the applicator comprises an ultrasonic wave generator or a vibrator, wherein the applicator is activated or set in motion by the ultrasonic wave generator or the vibrator; and (b) a light module, wherein the light module activates the bioactive compound or the liquid for growth or protection of hair, wherein the light module provides:

a dose in the range from 1 $J/cm^2$ to 10 $J/cm^2$ in 600-700 nm wavelength range, or a dose in the range from 1 $J/cm^2$ to 50 $J/cm^2$ in 780-950 nm wavelength range.

14. The apparatus according to claim 13, further comprising a massaging device for hair or scalp, wherein the massaging device comprises bristles.

15. The apparatus according to claim 13, further comprising an inductively coupled wireless electrical charger or a wired electrical charger.

16. The apparatus according to claim 13, further comprising a botanical extract in an emulsion.

17. The apparatus according to claim 13, further comprising a scaffold, wherein the scaffold is embedded with the bioactive compound or the bioactive compound encapsulated in a nanoshell.

18. The scaffold according to claim 17 is further configured to attach to hair or scalp.

19. The apparatus according to claim 13, further comprising a scaffold embedded with a biologically active molecule or a biologically active molecule encapsulated in a nanoshell.

20. The scaffold according to claim 19 is further configured to attach to hair or scalp.

* * * * *